US011540674B2

(12) United States Patent
Babuadze

(10) Patent No.: US 11,540,674 B2
(45) Date of Patent: Jan. 3, 2023

(54) COLLAPSIBLE SHOWER CUBICLE

(71) Applicant: Nodar Babuadze, Epsom (GB)

(72) Inventor: Nodar Babuadze, Epsom (GB)

( * ) Notice: Subject to any disclaimer, the term of this patent is extended or adjusted under 35 U.S.C. 154(b) by 0 days.

(21) Appl. No.: 16/755,302

(22) PCT Filed: Oct. 11, 2018

(86) PCT No.: PCT/GB2018/000133
§ 371 (c)(1),
(2) Date: Apr. 10, 2020

(87) PCT Pub. No.: WO2019/073188
PCT Pub. Date: Apr. 18, 2019

(65) Prior Publication Data

US 2021/0259479 A1 Aug. 26, 2021

(30) Foreign Application Priority Data

Oct. 12, 2017 (GB) ..... 1716713

(51) Int. Cl.
*A47K 3/32* (2006.01)

(52) U.S. Cl.
CPC ..... *A47K 3/325* (2013.01)

(58) Field of Classification Search
CPC ..... A47K 3/325; A47K 3/32
(Continued)

(56) References Cited

U.S. PATENT DOCUMENTS 118,750 A 9/1871 Scholl
1,145,568 A 7/1915 Dardano
(Continued)

FOREIGN PATENT DOCUMENTS

CN 201422802 Y 3/2010
CN 201968566 U 9/2011
(Continued)

OTHER PUBLICATIONS

GB 1716713.1, Search Report Under Section 17, datd Mar. 1, 2018, Further Search Report Under Section 17, datd Sep. 19, 2018.
(Continued)

*Primary Examiner* — Tuan N Nguyen
(74) *Attorney, Agent, or Firm* — Fay Sharpe LLP

(57) ABSTRACT

A collapsible shower cubicle (1) comprises a ceiling unit (23), a base unit (24), and a linking mechanism (40). The ceiling unit (23) is rotatable about an upper axis (9) between a raised extended position and a lowered retracted position, the ceiling unit (23) substantially extending horizontally from the upper axis (9) when the ceiling unit (23) is in its extended position. The base unit (37) is rotatable about a lower axis (10) between a lowered extended position and a raised retracted position, the base unit (37) substantially extending horizontally from the lower axis (10) when the base unit (37) is in its extended position. The linking mechanism connects the ceiling unit to the base unit. The linking mechanism (40) is configured to coordinate simultaneous rotation of the ceiling unit (23) and the base unit (37) between their retracted and extended positions and is configured such that the raising of the weight of the base unit (37) is counterbalanced by the lowering of the weight of the ceiling unit (23), and the lowering of the weight of the base unit (37) is counterbalanced by the raising of the weight of the ceiling unit (23).

22 Claims, 23 Drawing Sheets

(58) Field of Classification Search
USPC ..... 4/599
See application file for complete search history.

(56) References Cited

U.S. PATENT DOCUMENTS

| | | | | |
|---|---|---|---|---|
| 3,646,590 | A | 2/1972 | Bolt | |
| 3,869,734 | A | 3/1975 | Bolt et al. | |
| 4,606,084 | A | 8/1986 | Baus | |
| 5,544,369 | A | 8/1996 | Roberts | |
| 2016/0106251 | A1* | 4/2016 | Ramey ..... | A47K 3/38<br>4/608 |

FOREIGN PATENT DOCUMENTS

| | | | |
|---|---|---|---|
| CN | 203359247 | U | 12/2013 |
| DE | 3204053 | A1 | 3/1984 |
| DE | 3324277 | A1 | 4/1984 |
| DE | 102009018668 | A1 | 11/2010 |
| EP | 0 603 475 | A1 | 6/1994 |
| EP | 1374750 | A2 | 4/2006 |
| GB | 1267705 | A | 3/1972 |
| GB | 1337193 | A | 11/1973 |
| JP | S 6175188 | A | 4/1986 |
| WO | WO 2011053720 | | 5/2011 |

OTHER PUBLICATIONS

PCT/GB2018/000133, International Search Report, dated Jan. 29, 2019.

* cited by examiner

COLLAPSIBLE SHOWER CUBICLE

The present invention relates to a shower cubicle which is collapsible.

A conventional shower cubicle is a rigid structure that takes up some space in the room that it is situated.

It is an object of the present invention to provide a shower cubicle which can be collapsed when not in use to save space.

According to one aspect of the present invention there is provided a collapsible shower cubicle comprising: a ceiling unit rotatable about an upper axis between a raised extended position and a lowered retracted position, the ceiling unit substantially extending horizontally from the upper axis when the ceiling unit is in its extended position; a base unit rotatable about a lower axis between a lowered extended position and a raised retracted position, the base unit substantially extending horizontally from the lower axis when the base unit is in its extended position; and a linking mechanism connecting the ceiling unit to the base unit and configured to coordinate simultaneous rotation of the ceiling unit and the base unit between their retracted and extended positions and configured such that the raising of the weight of the base unit is counterbalanced by the lowering of the weight of the ceiling unit, and the lowering of the weight of the base unit is counterbalanced by the raising of the weight of the ceiling unit. The counterbalancing enables the shower cubicle to be collapsed or erected with little force.

The collapsible shower cubicle may include a drive mechanism for driving the linking mechanism to selectively rotate the ceiling unit and the base unit towards each other from their extended positions or to rotate the ceiling unit and the base unit away from each other from their retracted positions. Since little force is required to collapse or erect the shower cubicle, a low power motor may be used to drive the linking mechanism.

The ceiling unit may include a ceiling panel rotatable about the upper axis. The ceiling unit may include a ceiling link fixed to the ceiling panel and rotatable with the ceiling panel.

The base unit may include a base panel rotatable about the lower axis. The base unit may include a base link fixed to the base panel and rotatable with the base panel.

The collapsible shower cubicle may include an upper link member pivotably attached directly or indirectly to the ceiling panel of the ceiling unit, a lower link member pivotably attached directly or indirectly to the base panel of the base unit, a door frame pivotably attached to the upper and lower link members, and a door connected to the door frame for entry into the collapsible shower cubicle. When the ceiling unit is rotated from the raised extended position to the lowered retracted position and the base unit is rotated from the lowered extended position to the raised retracted position, the door frame may be translated towards the upper and lower axes, and when the ceiling unit is rotated from the lowered retracted position to the raised extended position and the base unit is rotated from the raised retracted position to the lowered extended position, the door frame may be translated away from the upper and lower axes.

The door and the door frame may each have at least one magnet for interacting with each other to dampen movement of the door relative to the door frame.

The collapsible shower cubicle may include a ceiling linkage configured to rotate the upper link member relative to the ceiling panel. The ceiling linkage may connect the upper link member to a ceiling shaft coaxial with the upper axis. The collapsible shower cubicle may include a base linkage configured to rotate the lower link member relative to the base panel. The base linkage may connect the lower link member to a base shaft coaxial with the lower axis.

The linking mechanism may connect the ceiling unit to the base unit about the upper and lower axes. The linking mechanism may comprise a belt or chain or any other suitable means in a figure-of-eight configuration connecting the ceiling unit to the base unit and extending around the upper and lower axes. The belt or chain may extend around an upper wheel rotatable about the upper axis and may extend around a lower wheel rotatable about the lower axis, the ceiling unit being fixed to the upper wheel and the base unit being fixed to the lower wheel. The wheel may be a gear wheel or a pulley wheel.

A method may be provided for erecting or collapsing the shower cubicle which comprises rotating the ceiling and base units between extended position and retracted positions.

According to another aspect of the present invention there is provided a collapsible shower cubicle comprising: a pair of side panels movable between extended positions and retracted positions; a ceiling unit movable between a raised extended position and a lowered retracted position; a base unit movable between a lowered extended position and a raised retracted position; an upper link member pivotably attached to the ceiling unit; a lower link member pivotably attached to the base unit, and a door frame pivotably attached to the upper and lower link members, and a door connected to the door frame for entry into the collapsible shower cubicle, wherein the shower cubicle is in an erected state when the side panels; the ceiling unit and the base unit are in their extended positions, and the shower cubicle is in a collapsed state when the side panels, the ceiling unit and the base unit are in their retracted positions, and wherein when the collapsible shower cubicle is moved from its erected state to its collapsed state, the side panels are moved towards their retracted positions before the base unit is moved to its retracted position. By the shower cubicle having the door frame, a stable entrance into the cubicle is provided when the cubicle is in its erected state. By the side panels being moved towards their retracted positions before the base unit is moved to its retracted position, drips from the side panels are caught by the base unit before the base unit is raised to its retracted position.

The base unit may include a floor panel that is rotated from a lowered extended position to a raised retracted position. The floor panel in its raised retracted position may cover at least a portion of the side panels in their retracted positions. The floor panel may have a pair of shoulders and wherein each side panel may be adjacent a respective said shoulder when the side panels and the base unit are in their extended positions, the side panels being between the shoulders.

The collapsible shower cubicle may include a drain for collecting water from the floor panel as it is being rotated from its extended position to its retracted position.

A method may be provided for erecting or collapsing the shower cubicle.

An embodiment of the present invention will now be described, by way of example, with reference to the accompanying drawings, in which.

Figure 1:
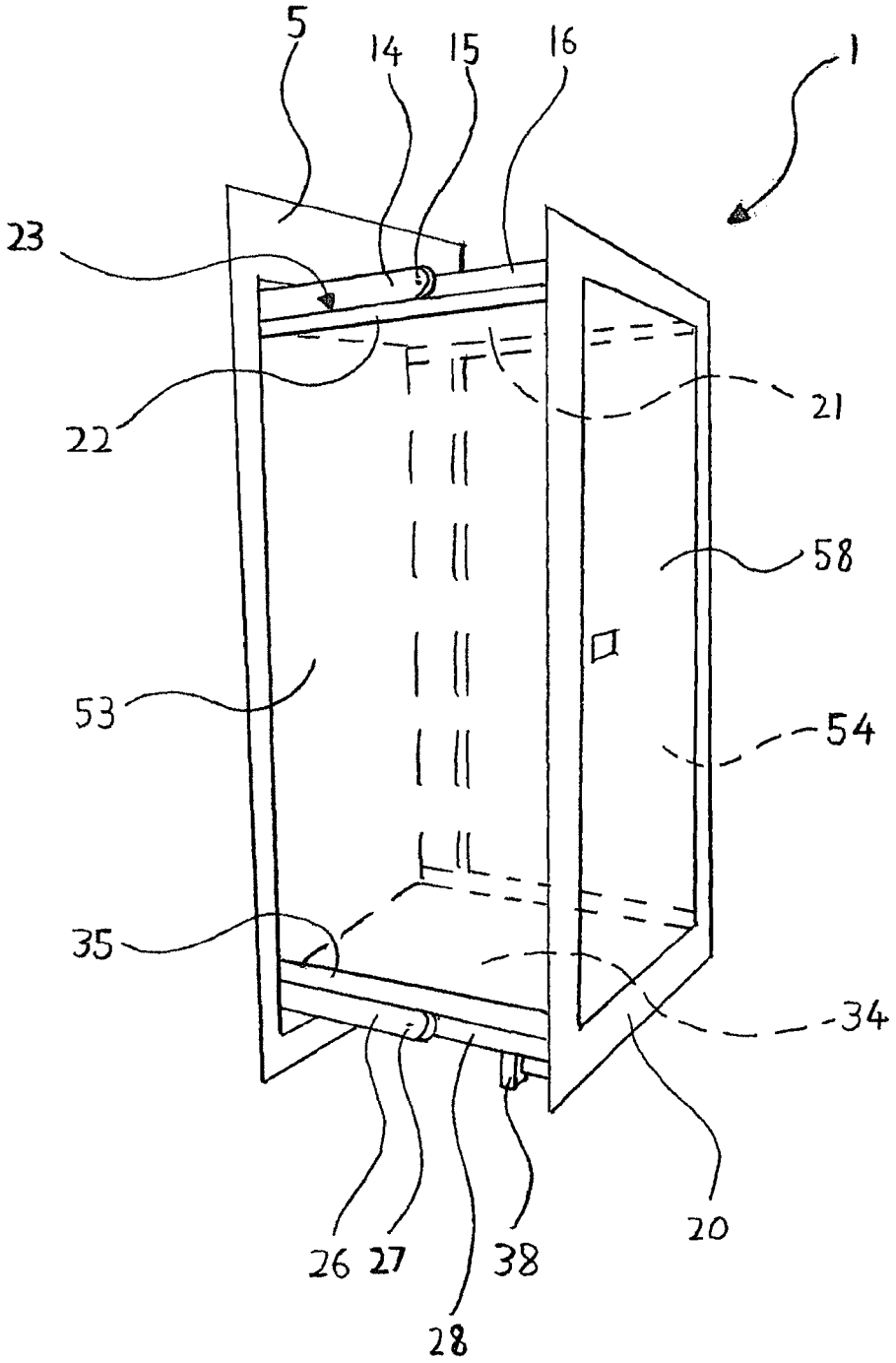
FIG. 1 is a schematic view of a collapsible shower cubicle in accordance with an embodiment of the present invention in an erected state.
Figure 2:
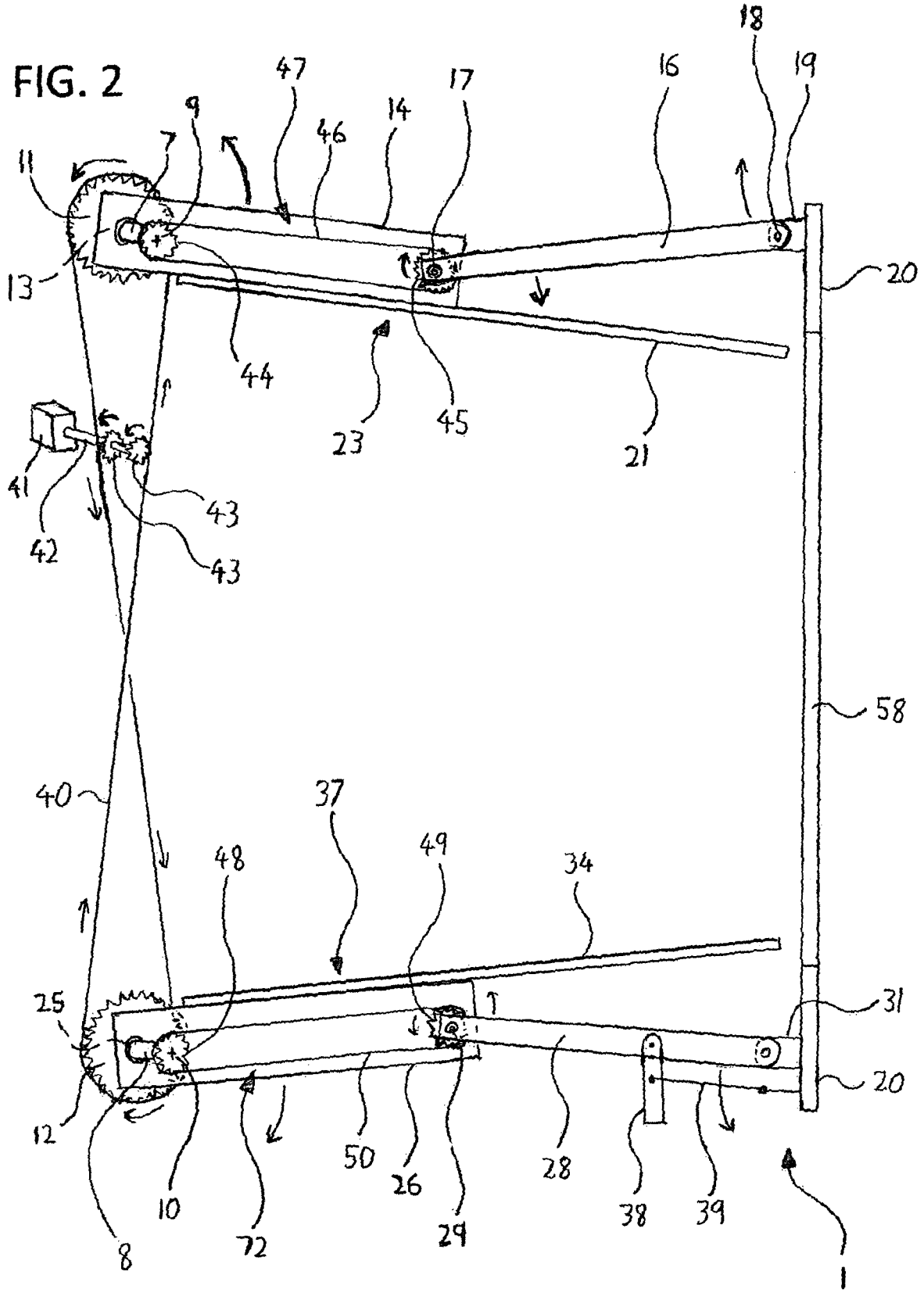
FIG. 2 is a schematic side elevational view of the shower cubicle.
Figure 3:
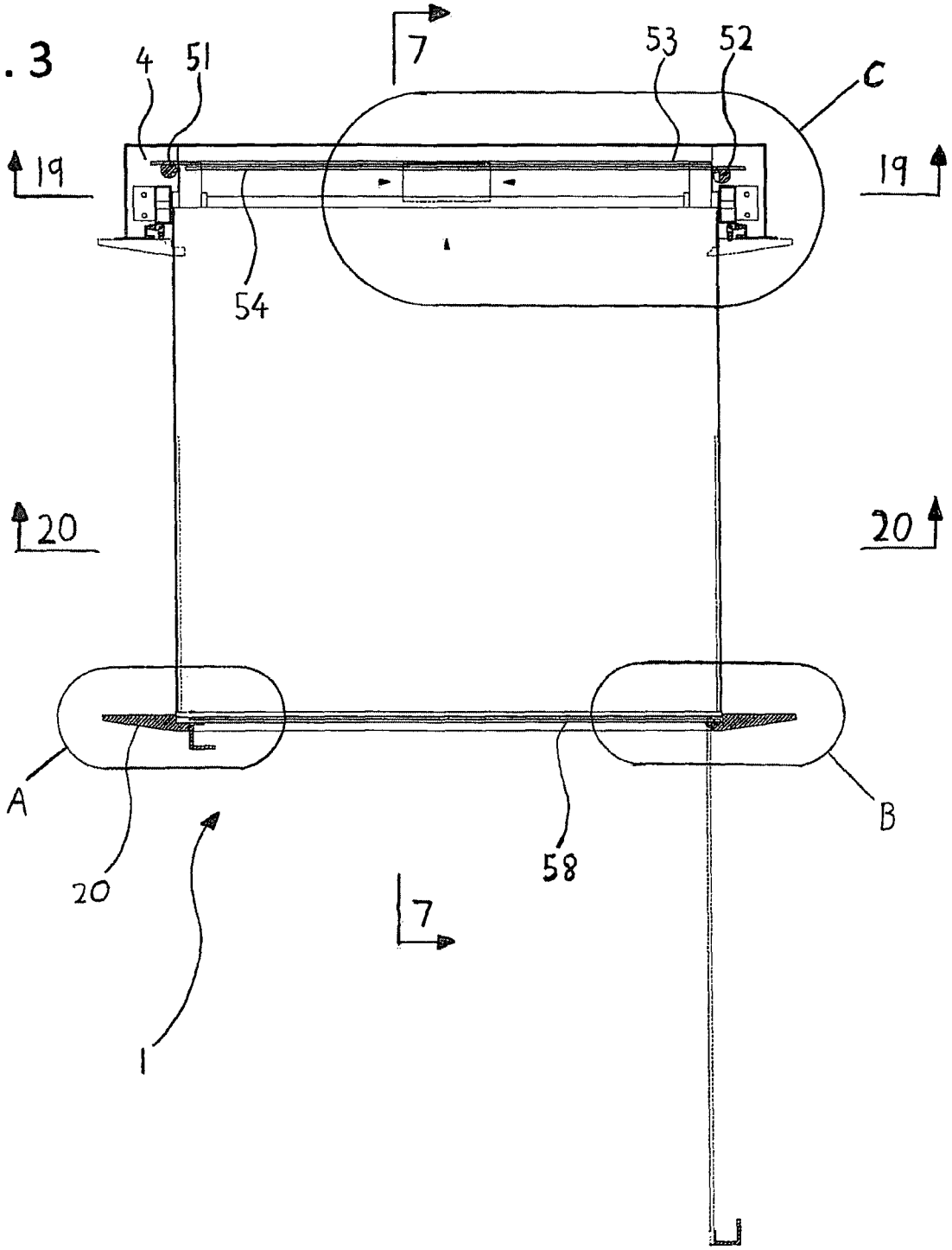
FIG. 3 is a top plan view of the shower cubicle in its erected state.
Figure 4:
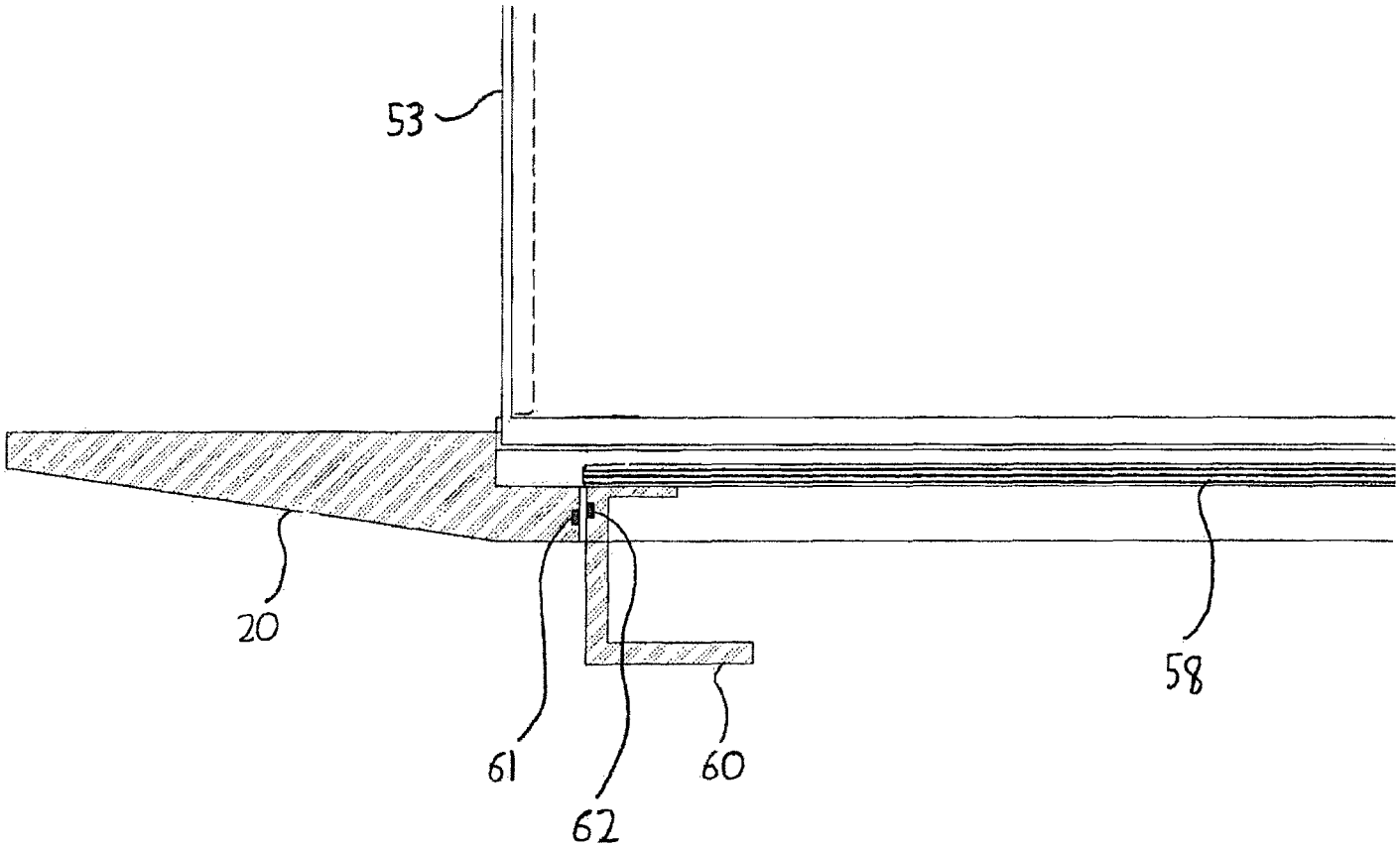
FIGS. 4, 5 and 6 are details labelled A, B, and C, respectively, on FIG. 3.
Figure 5:
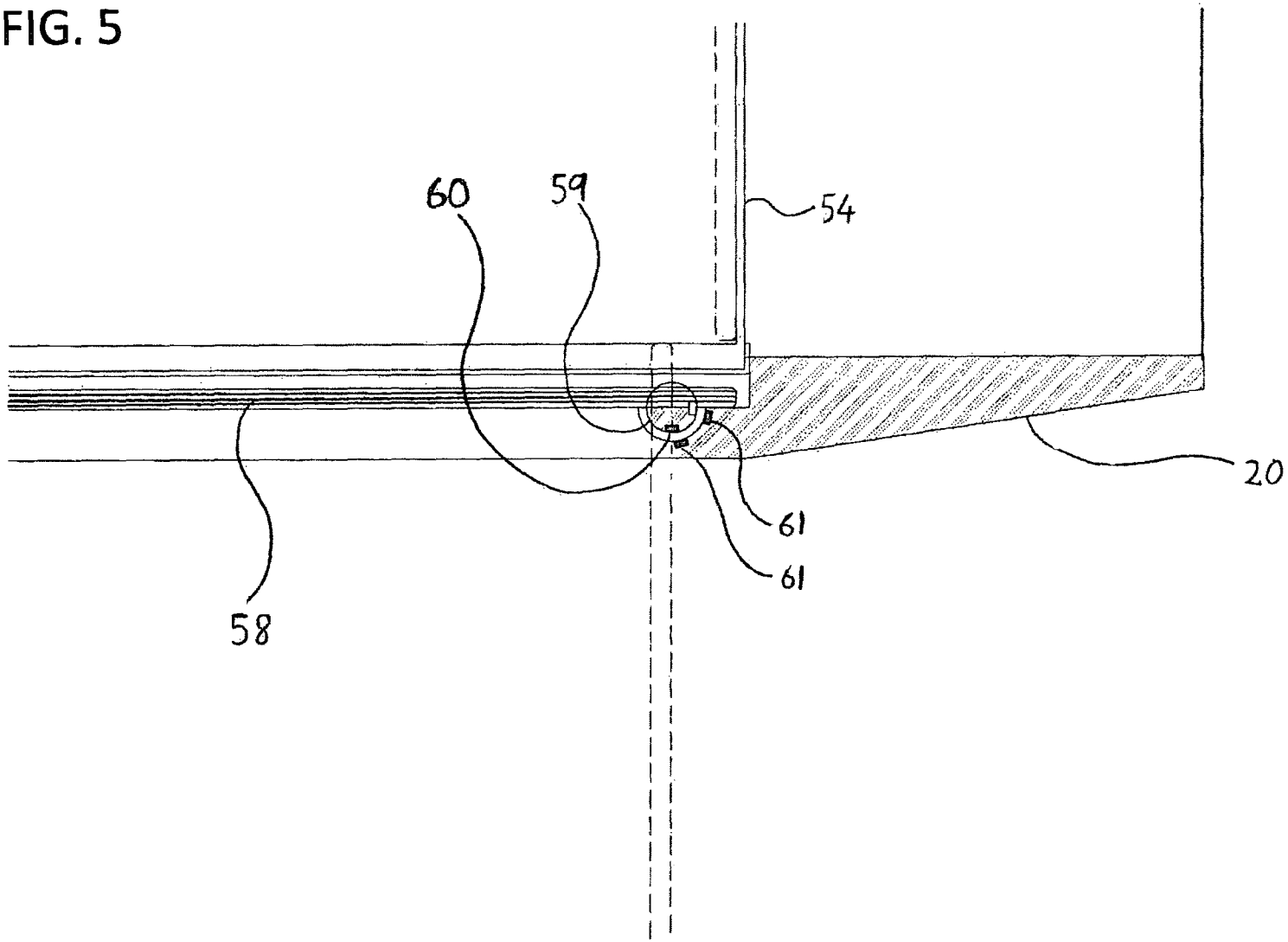
Figure 6:
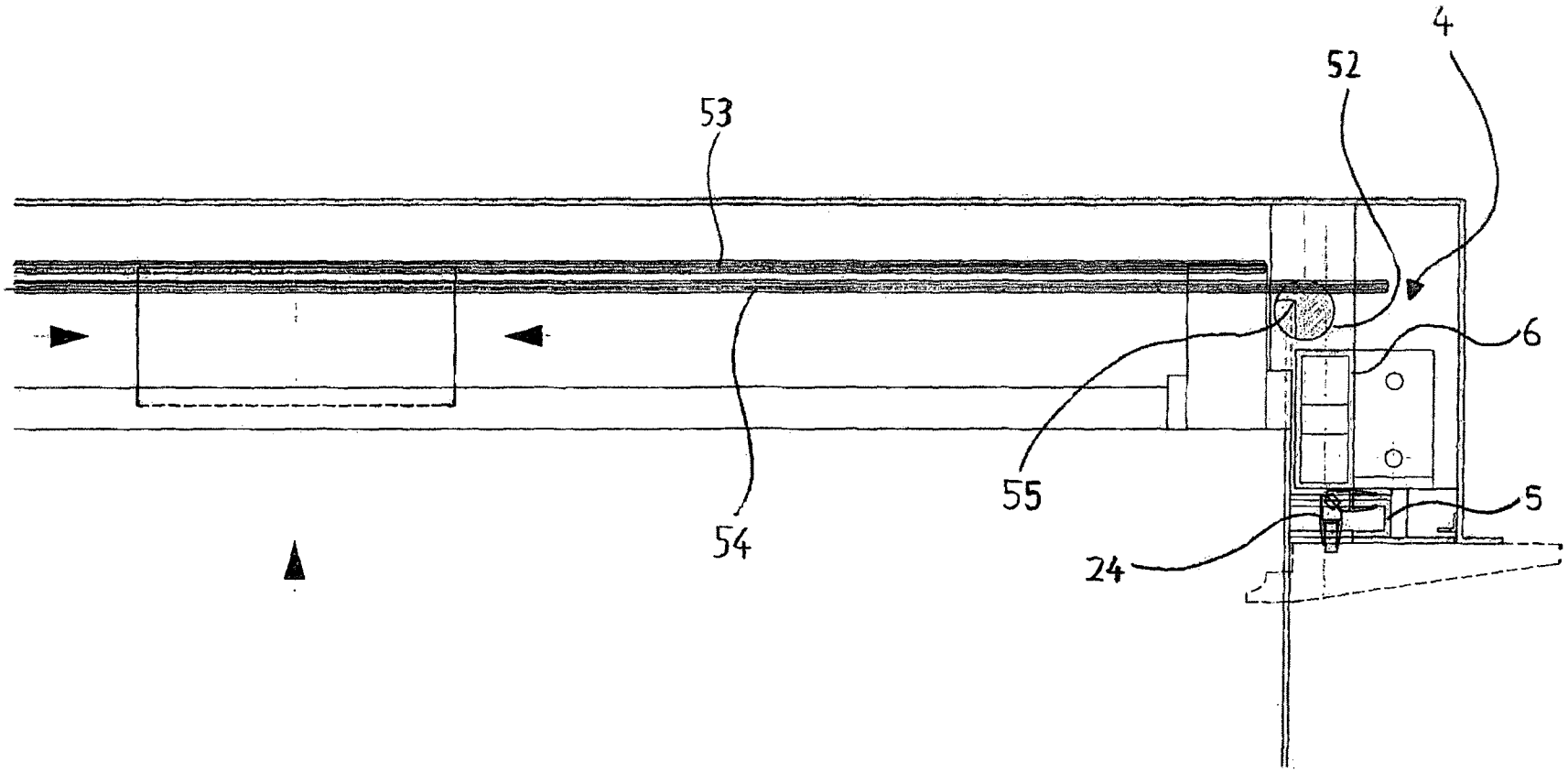
Figure 7:
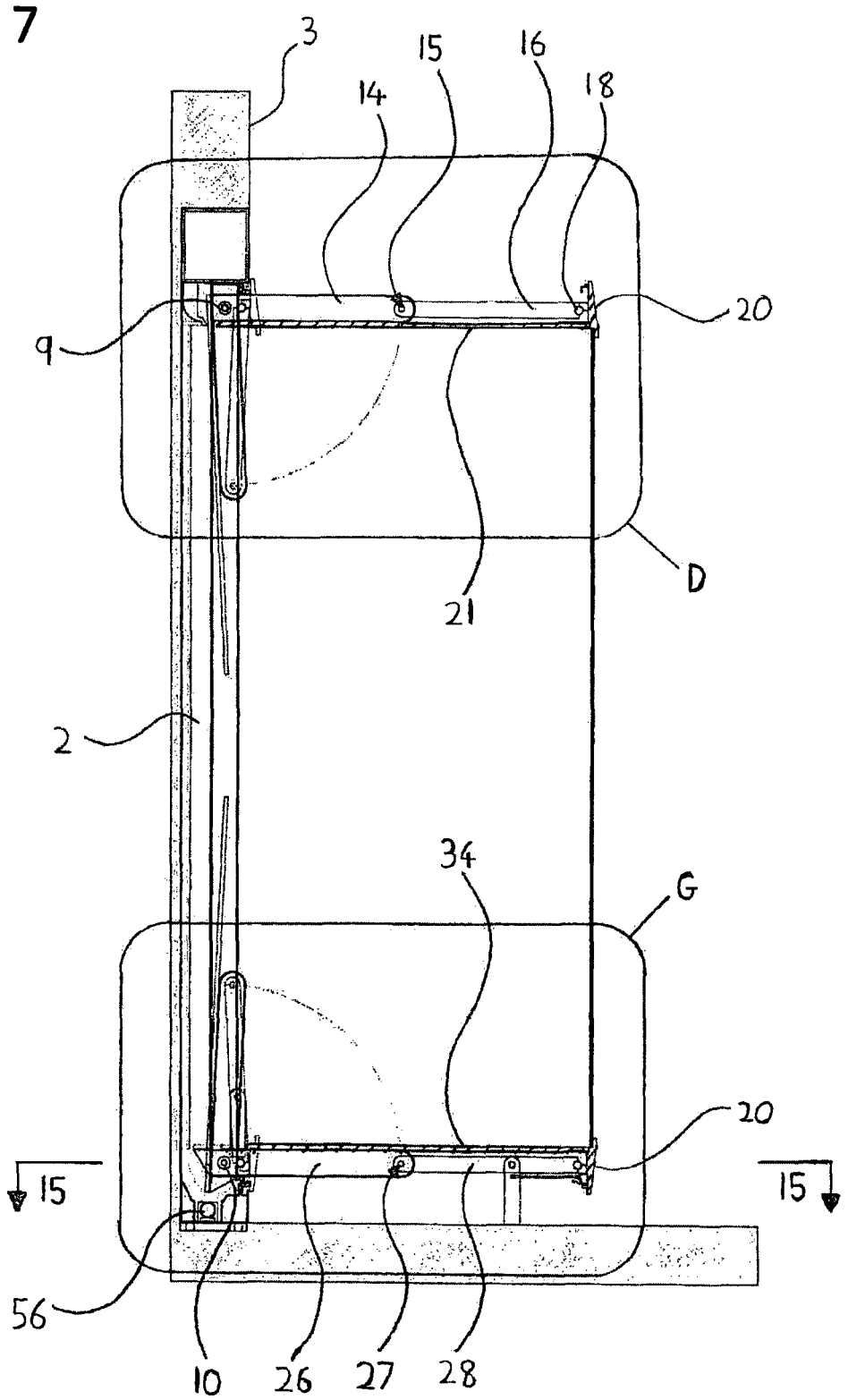
FIG. 7 is a side cross-sectional view taken along lines 7-7 of FIG. 3.
Figure 8:
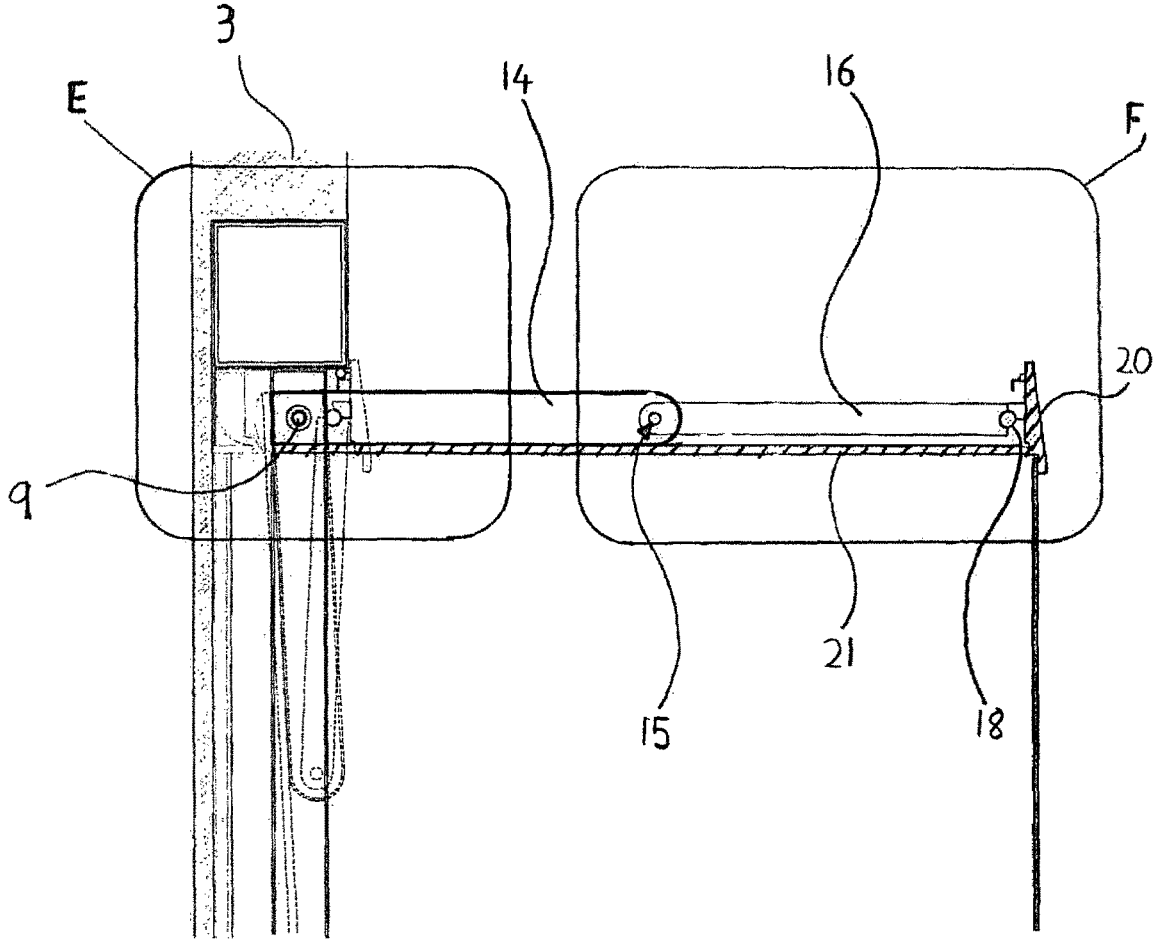
FIG. 8 is an upper part of the side cross-sectional view labelled D on FIG. 7.
Figure 9:
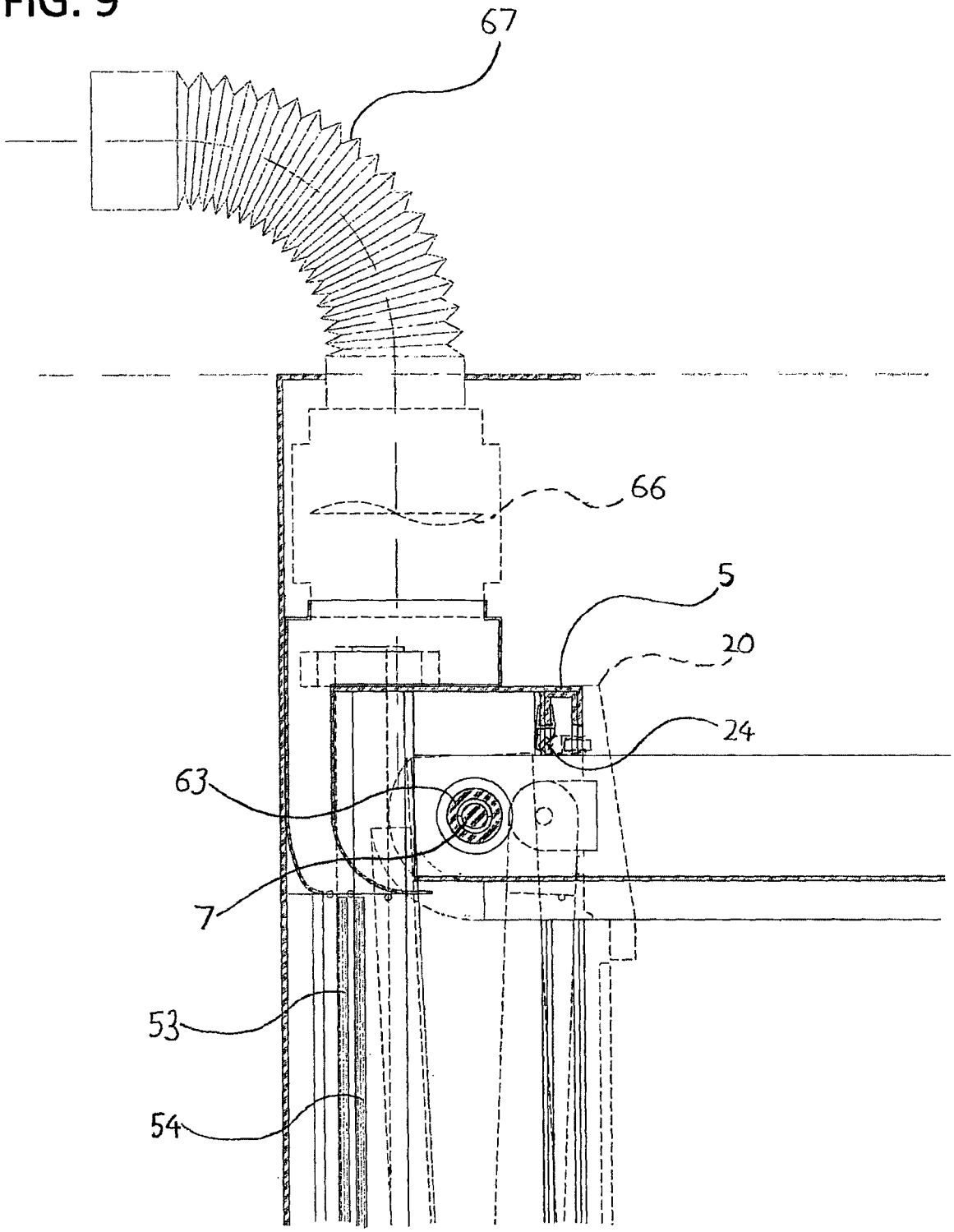
FIGS. 9 and 10 are details labelled E and F, respectively, on FIG. 8.
Figure 10:
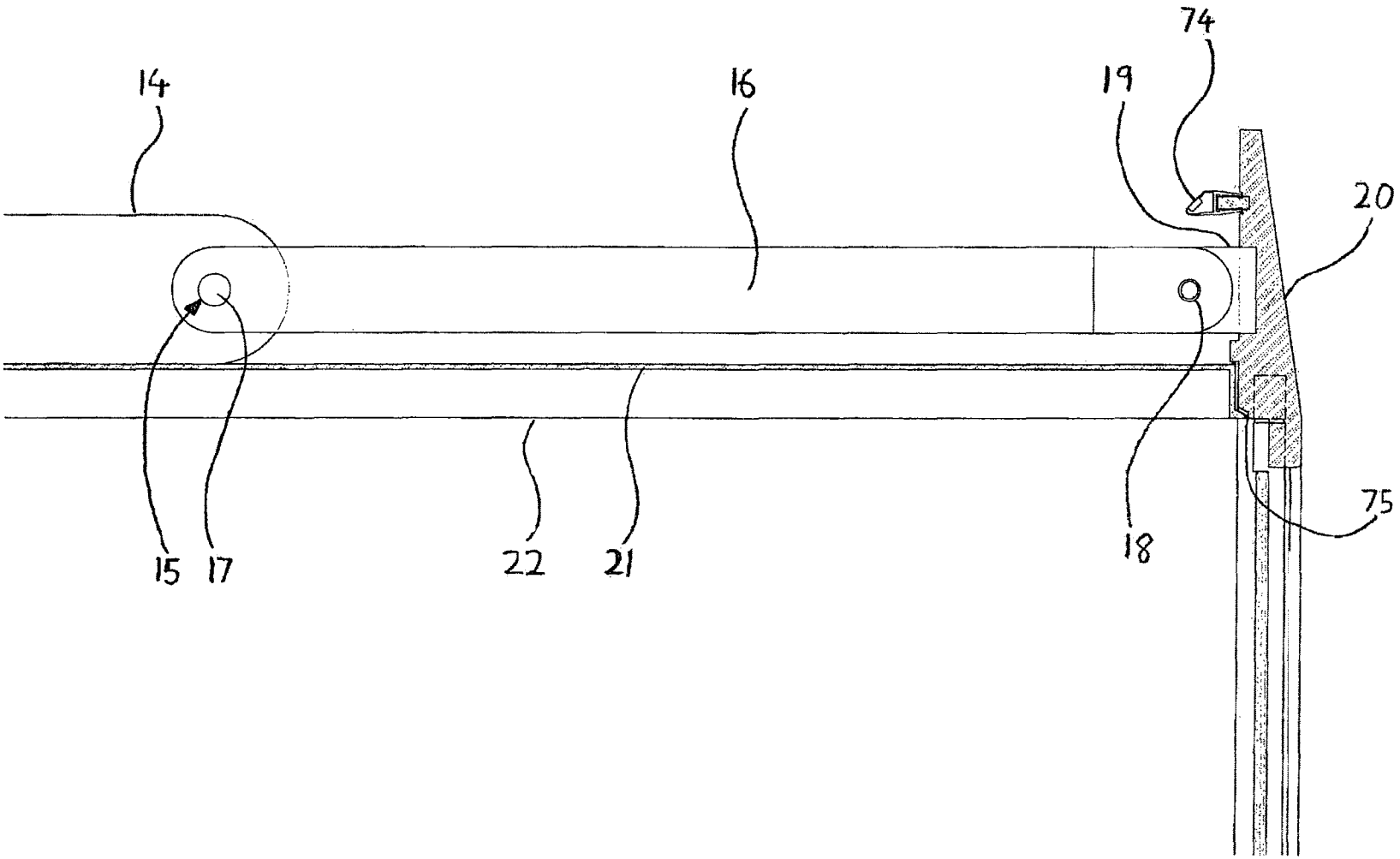
Figure 11:
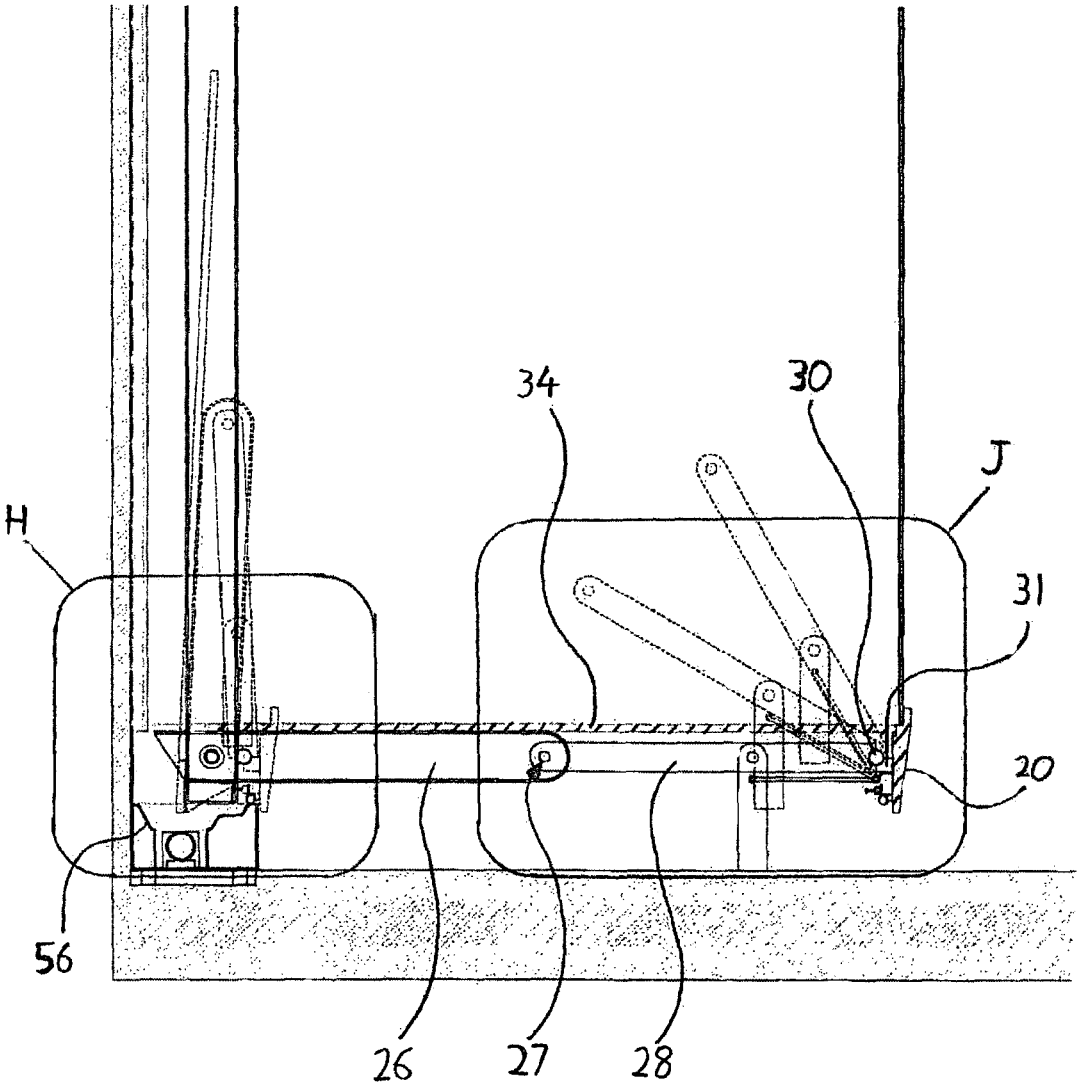
FIG. 11 is a lower part of the side cross-sectional view labelled G on FIG. 7.
Figure 12:
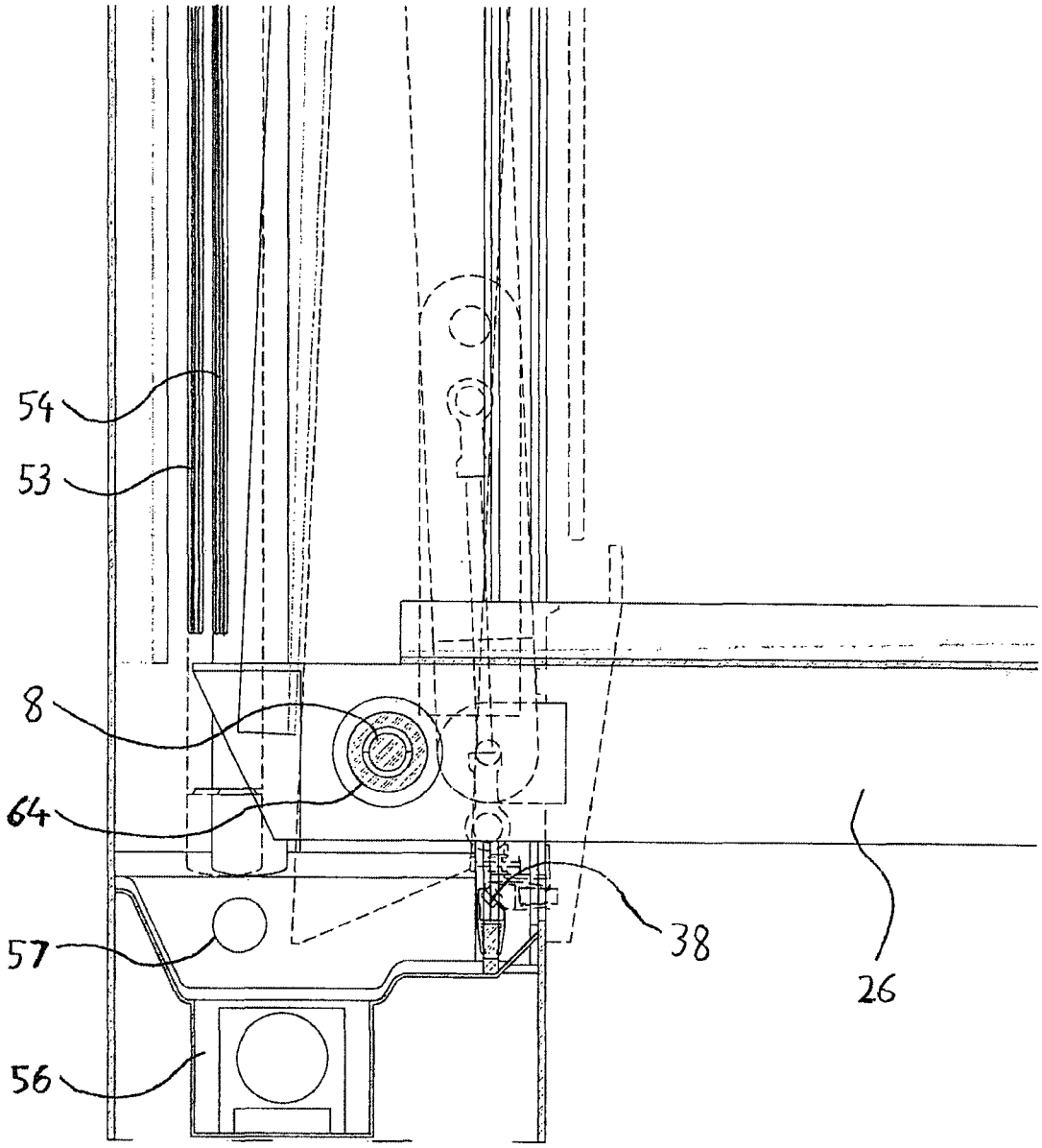
FIGS. 12 and 13 are details labelled H and J, respectively, on FIG. 11.
Figure 13:
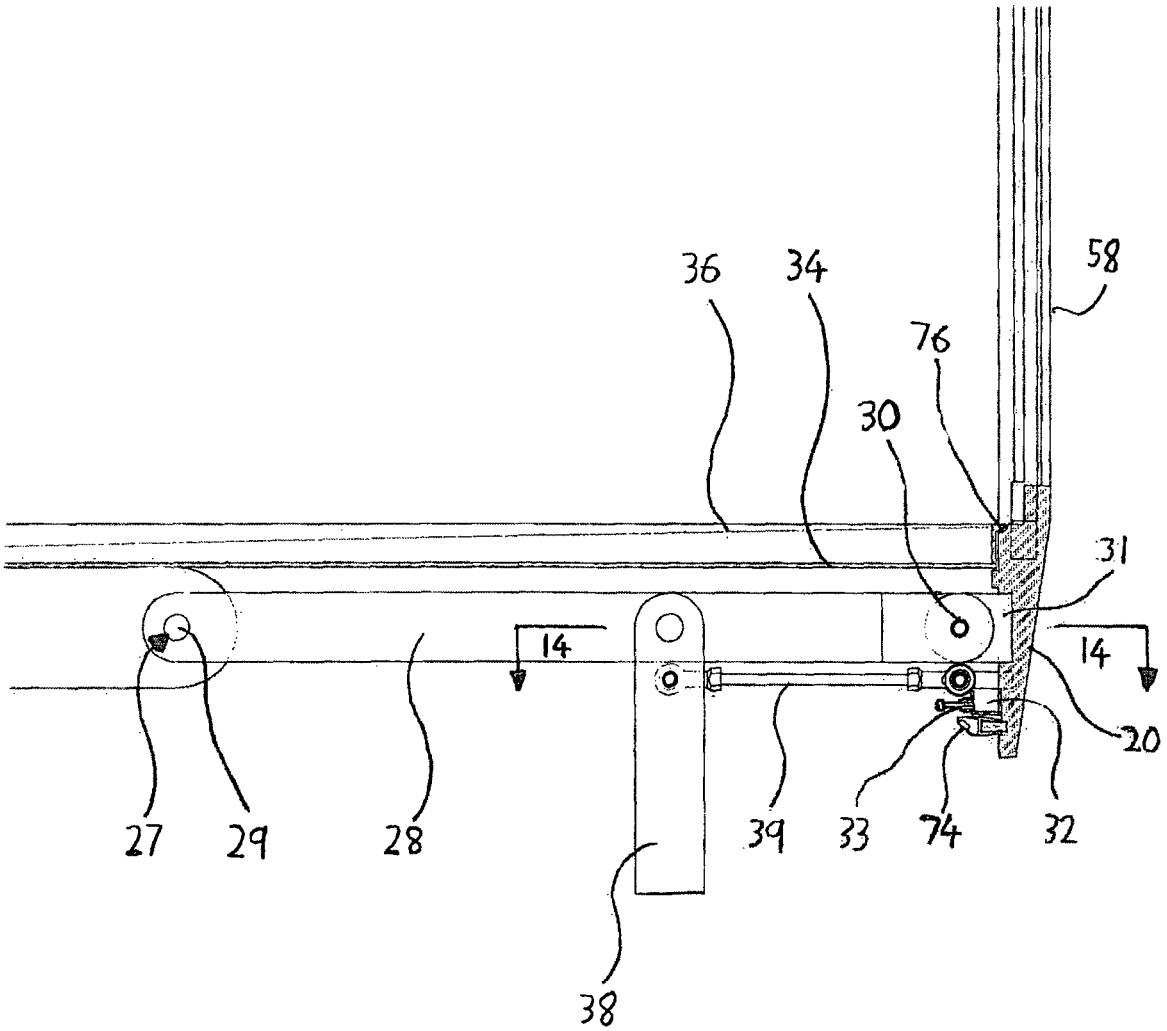
Figure 14:
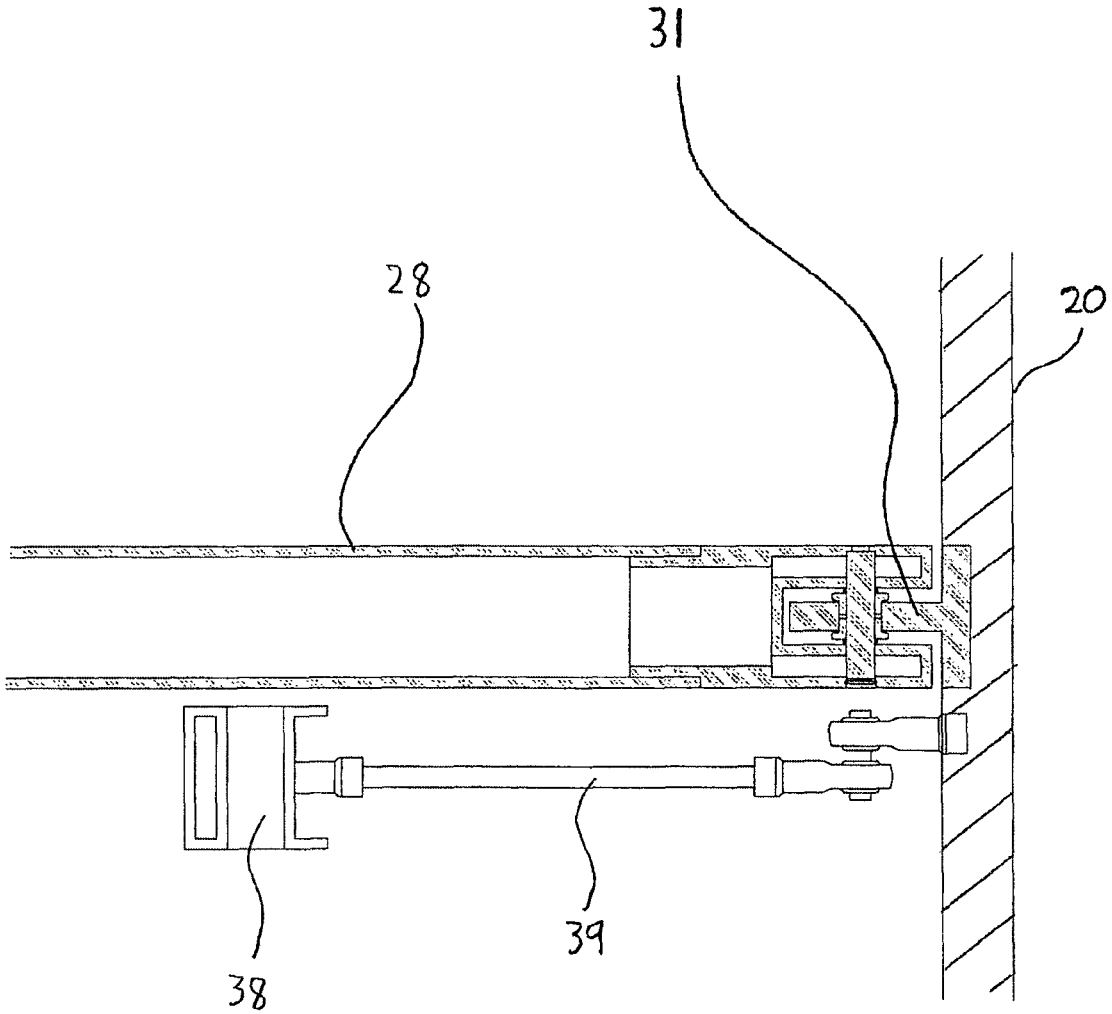
FIG. 14 is a sectional view taken along lines 14-14 of FIG. 13.
Figure 15:
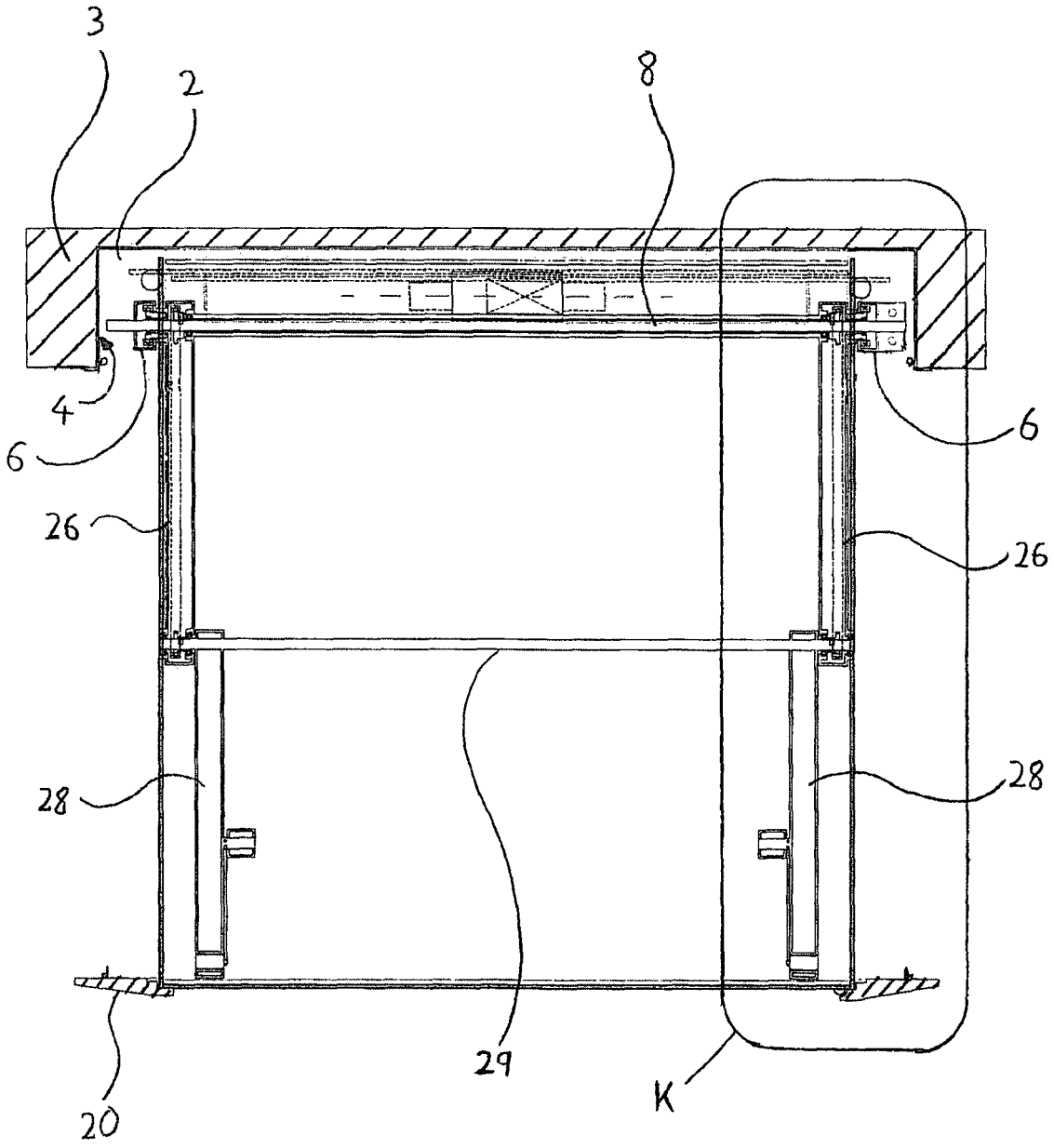
FIG. 15 is a sectional view plan view of the shower cubicle in its erected state taken along lines 15-15 of FIG. 7.
Figure 16:
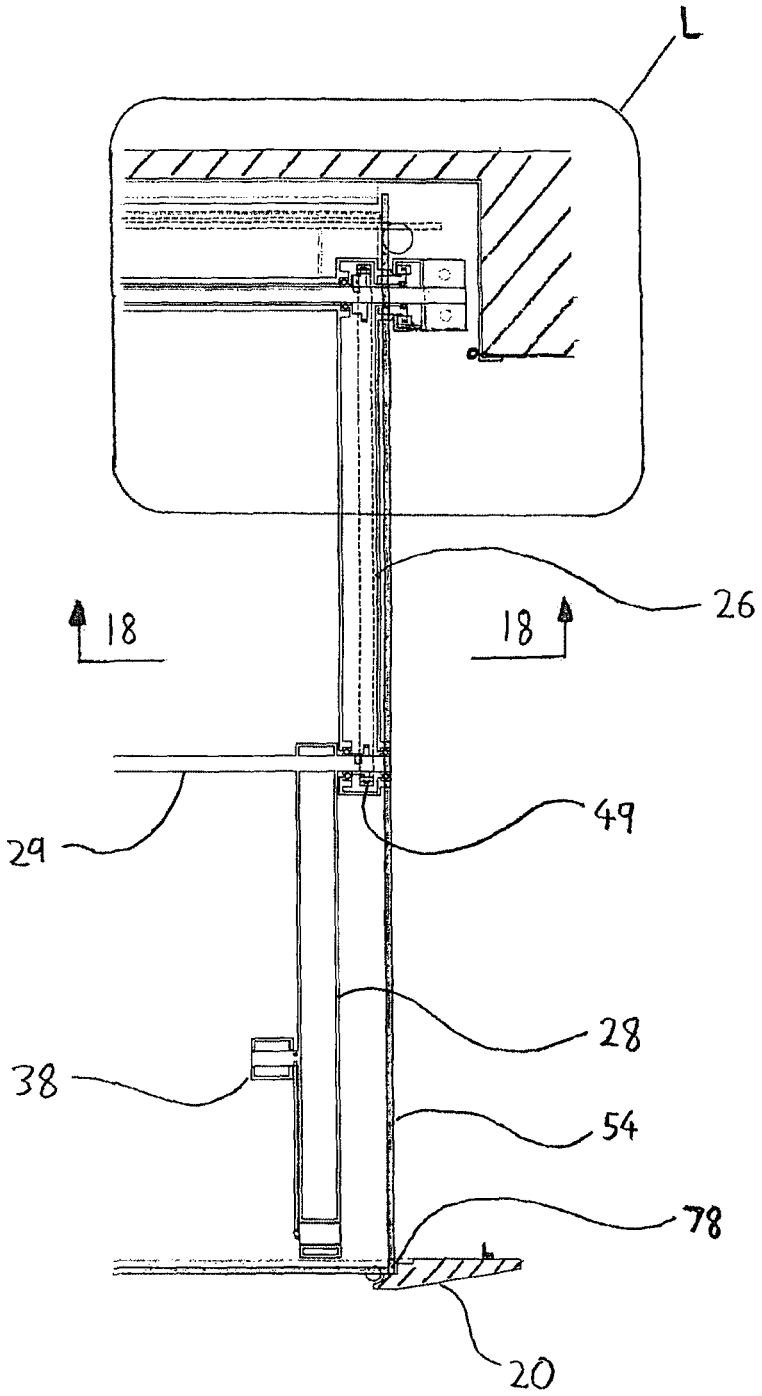
FIG. 16 is a detail labelled K on FIG. 15.
Figure 17:
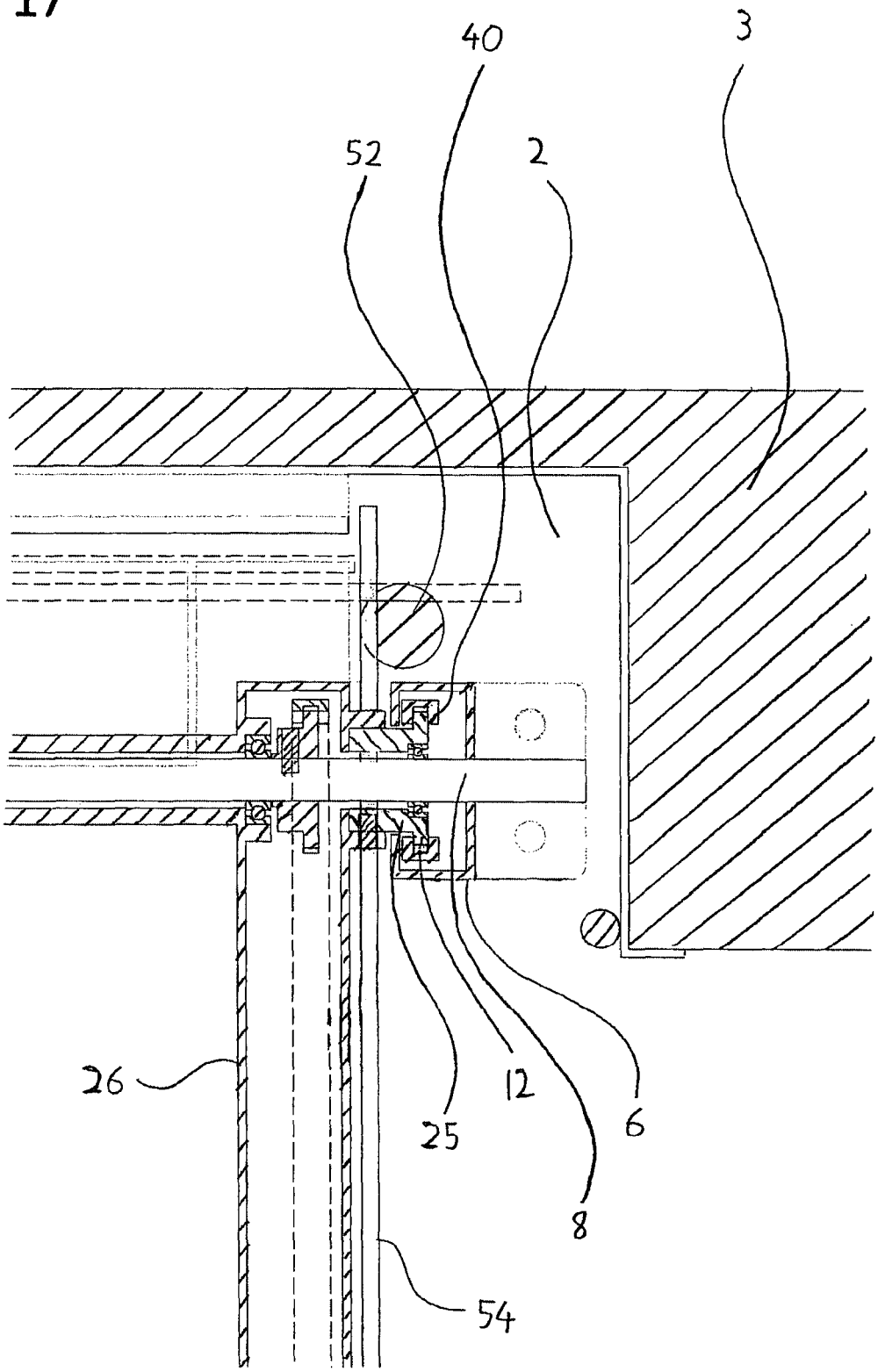
FIG. 17 is a detail labelled Lon FIG. 16.
Figure 18:
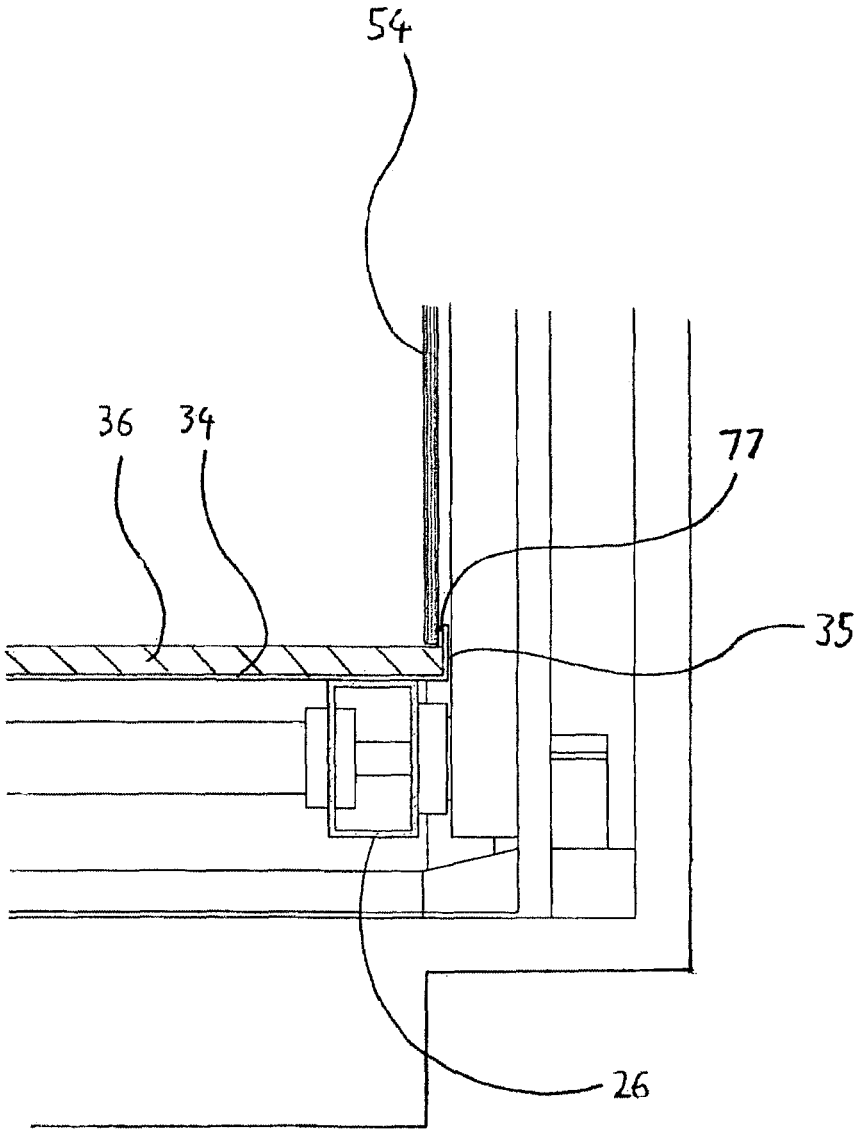
FIG. 18 is a sectional view taken along lines 18-18 of FIG. 16.
Figure 19:
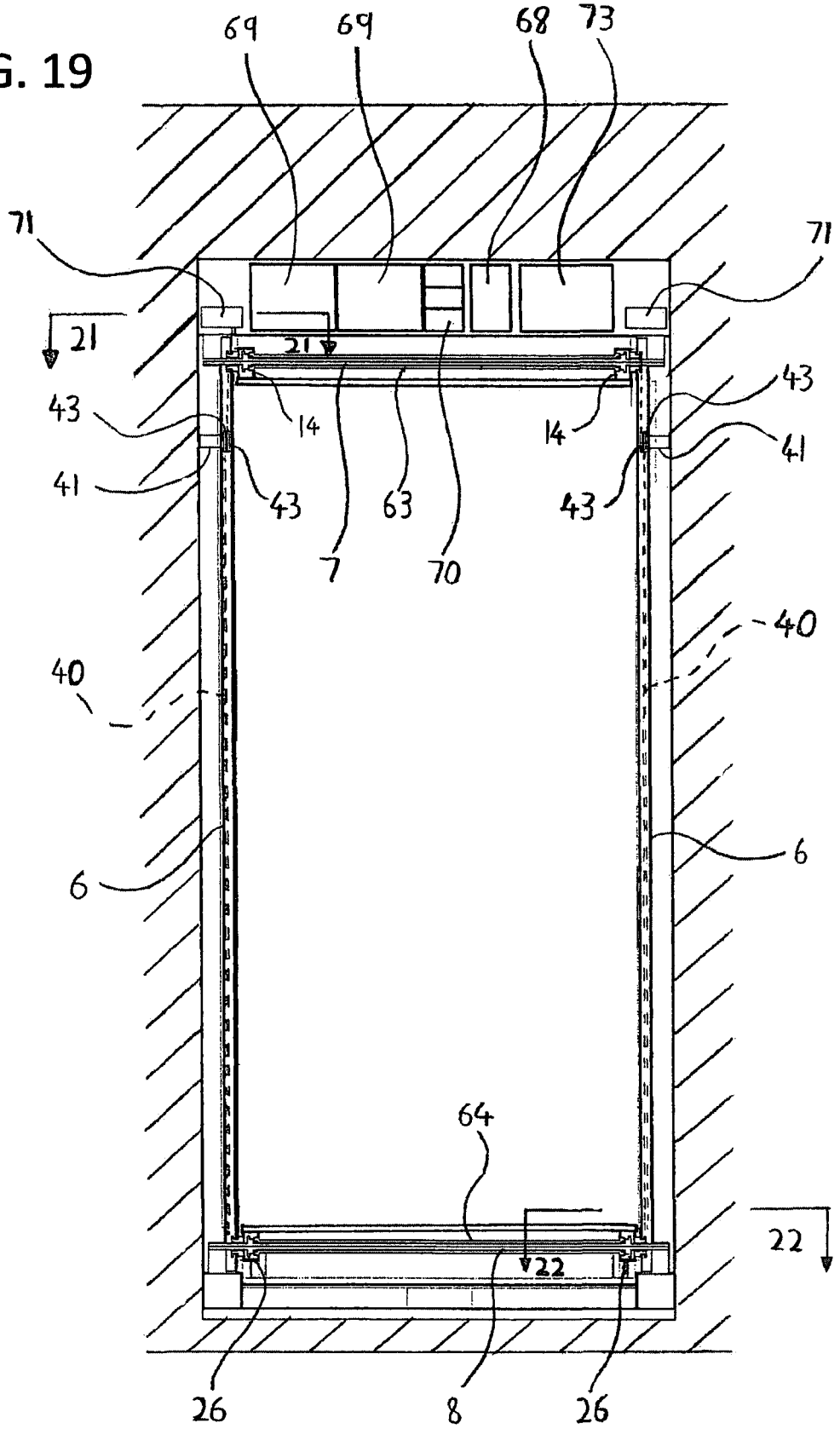
FIG. 19 is a rear cross-sectional view taken along lines 19-19 of FIG. 3.
Figure 20:
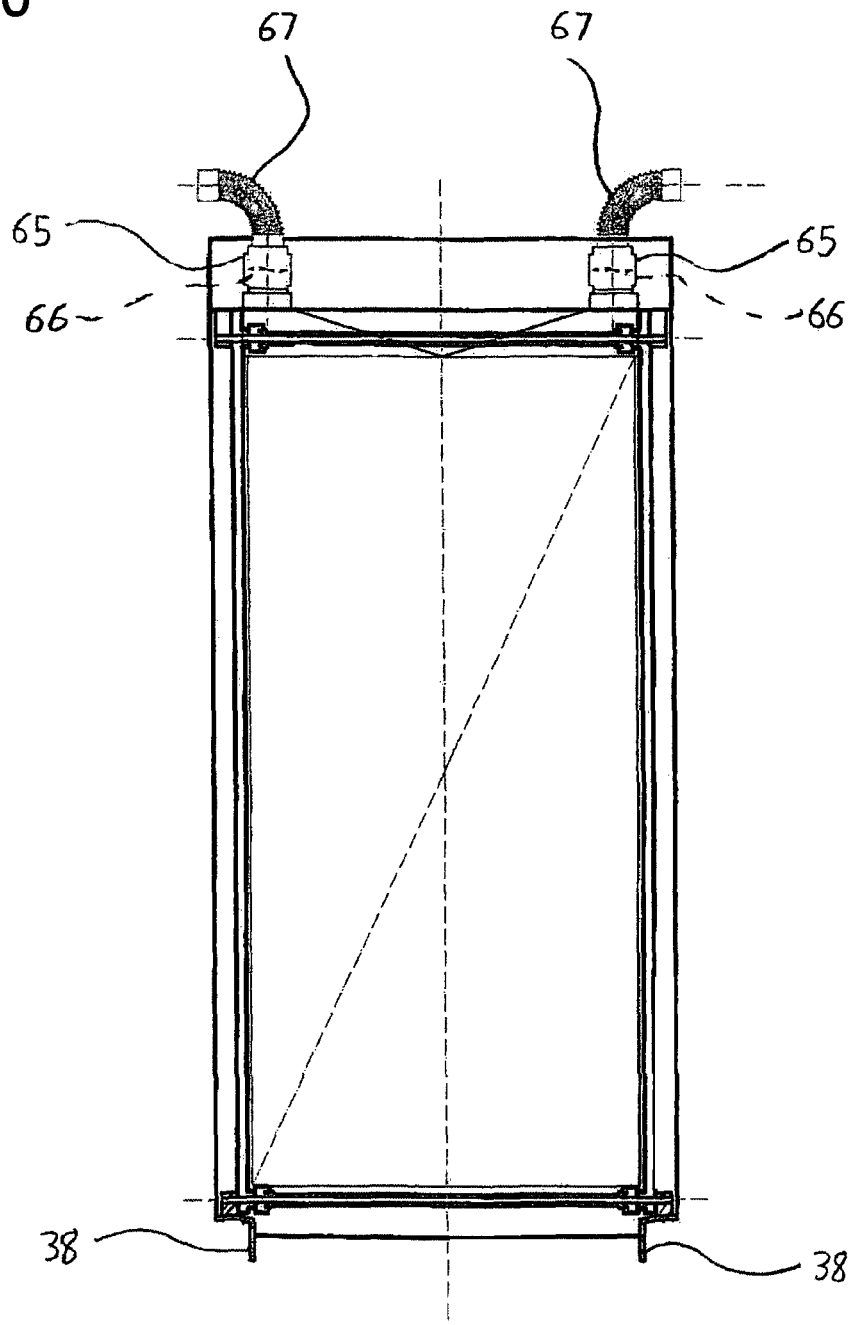
FIG. 20 is a cross-sectional view taken along lines 20-20 of FIG. 3.
Figure 21:
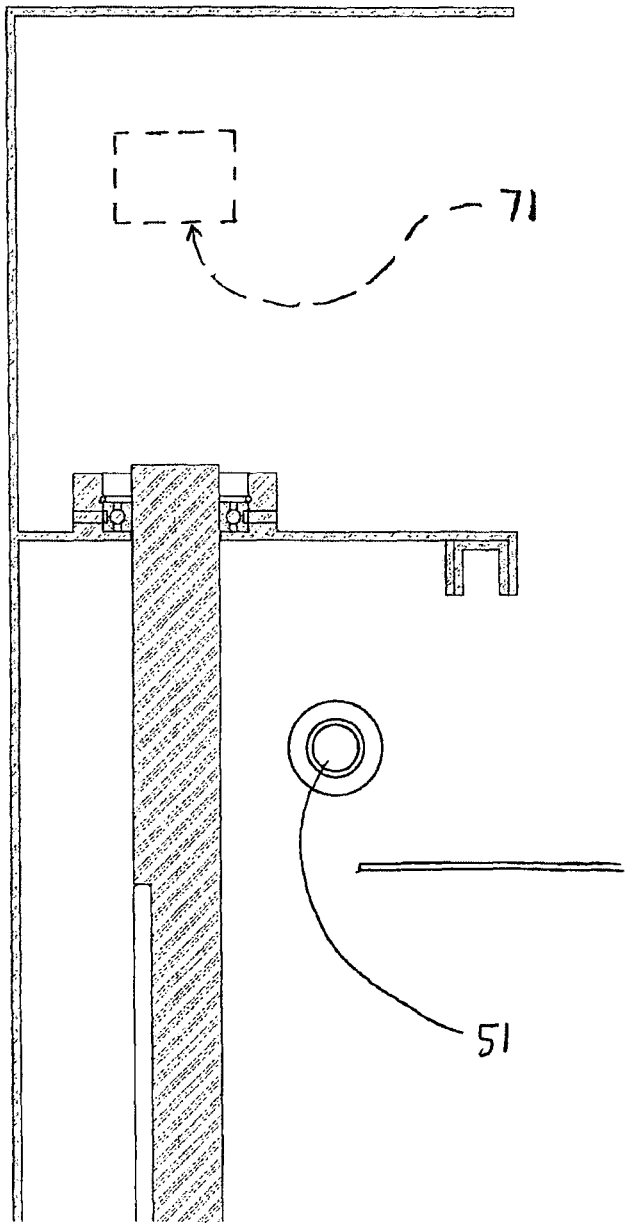
Figure 22:
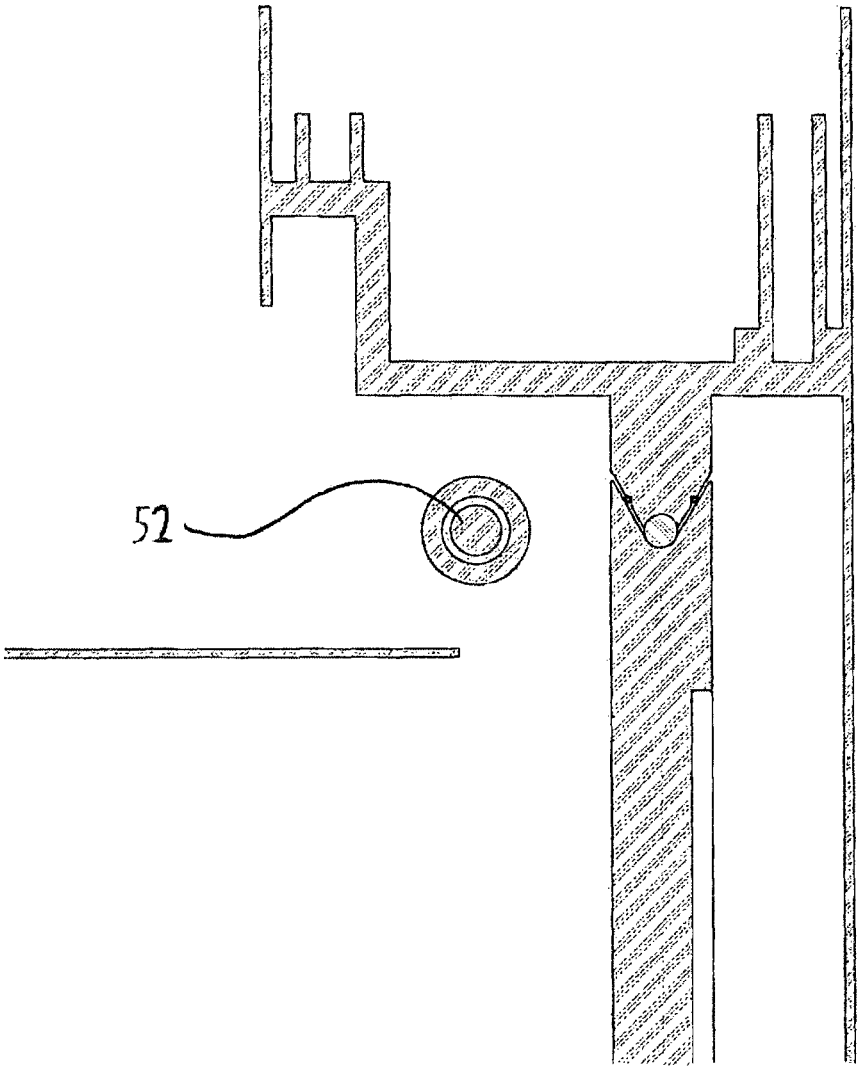
Figure 23:
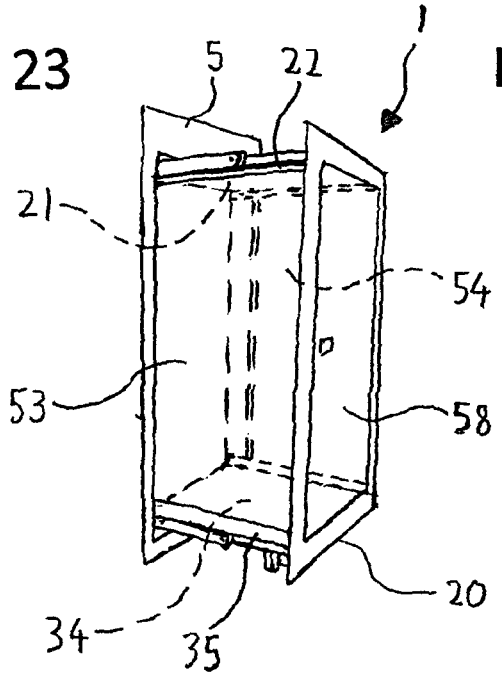
Figure 24:
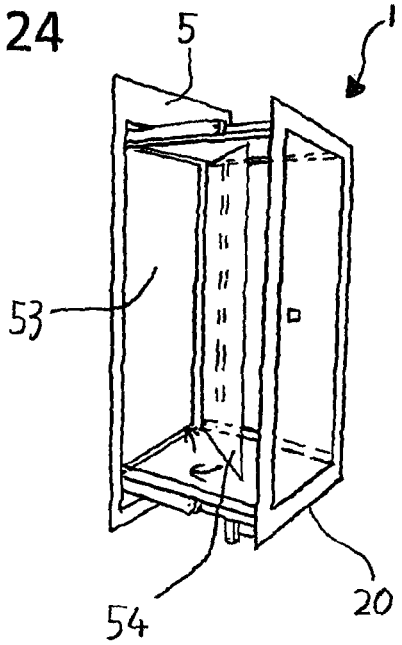

FIGS. 21 and 22 are sectional view taken along lines 21-21 and lines 22-22 of FIG. 19; and FIGS. 23 to 27 are schematic perspective views of the shower cubicle being collapsed from its erected state to a retracted state.

Referring to FIGS. 1 to 22 of the accompanying drawings, a collapsible shower cubicle 1 according to an embodiment of the invention is mounted in a recess 2 in a wall 3. The collapsible shower cubicle 1 has a mounting frame 4 mounted in the recess 2. The mounting frame 4 includes a seal frame 5.

The mounting frame 4 has a pair of columns 6 (see FIG. 15) between which are mounted upper and lower shafts 7, 8 wherein the upper or ceiling shaft 7 is coaxial with an upper axis 9 and the lower or base shaft 8 is coaxial with a lower axis 10. The upper and lower shafts 7, 8 are fixed. A pair of upper gear wheels 11 is rotatable about the upper shaft 7 and a pair of lower gear wheels 12 is rotatable about the lower shaft 8. Each column 6 contains one of the upper gear wheels 11 and one of the lower gear wheels 12.

An upper cylinder 13 extends from each upper gear wheel 11 around the upper shaft 7 and protrudes through the column 6 in the direction of the other cylinder. A first end of a ceiling link arm 14 is attached to a distal end of each upper cylinder 13 which is just beyond the column 6. An opposite second end of the ceiling link arm 14 is connected by a link pivot connection 15 to a first end of an upper link member 16. The link pivot connection 15 comprises an upper link shaft 17 that extends between the pair of ceiling link arms 14, and the upper link shaft 17 is rotatably mounted in the pair of ceiling link arms 14. The first end of the upper link member 16 is fixed to the upper link shaft 17, and an opposite second end of the upper link member 16 is connected by a pivot connection 18 to an upper extension 19 extending from a rear of an upper part of a door or picture frame 20. The two ceiling link arms 14 are connected to each other by a tube 63 through which the upper shaft 7 extends. A ceiling panel 21 is fixed to the pair of ceiling link arms 14 and extends along the length of the ceiling link arms 14 and beyond in a direction away from the upper shaft 7. The edges 22 of the ceiling panel 21 parallel to the ceiling link arms 14 extend downwardly from the main part of the ceiling panel 21. The pair of ceiling link arms 14 and the ceiling panel 21 form a ceiling unit 23. Each ceiling link arm 14 has a seal 24 extending from a top side away from the ceiling panel 21 to an outer side away from the other ceiling link arm and down to the ceiling panel 21. A shower head and lighting (not shown) are connected to the ceiling panel 21.

A lower cylinder 25 extends from each lower gear wheel 12 around the lower shaft 8 and protrudes through the column 6 in the direction of the other cylinder. A first end of a base link arm 26 is attached to a distal end of each lower cylinder 25 which is just beyond the column 6. An opposite second end of the base link arm 26 is connected by a link pivot connection 27 to a first end of a lower link member 28. The link pivot connection 27 comprises a lower link shaft 29 that extends between the pair of base link arms 26, and the lower link shaft 29 is rotatably mounted in the pair of base link arms 26. The first end of the lower link member 28 is fixed to the lower link shaft 29, and an opposite second end of the lower link member 28 is connected by a pivot connection 30 to a lower extension 31 extending from a rear of a lower part of the door frame 20. A drip tray 32 (see FIG. 13) is attached to the door frame 20 beneath the pivot connection 30, and the drip tray 32 has a spring operated valve 33. The two base link arms 26 are connected to each other by a tube 64 through which the lower shaft 8 extends. A floor panel or plate 34 is fixed to the pair of base link arms 26 and extends along the length of the base link arms 26 and beyond in a direction away from the lower shaft 8. The floor panel 34 has a pair of shoulders or upstands 35 wherein each shoulder 35 extends along an edge of the floor panel 34 parallel to the base link arms 26. The floor panel 34 may include a glass infill 36 between the shoulders 35. The pair of base link arms 26 and the floor panel 34 form a base unit 37. Each base link arm 26 has a seal 38 extending from an underside away from the floor panel 34 to an outer side away from the other base link arm and up to the floor panel 34.

Each of the lower link members 28 has a leg 38 pivotably connected to it. A rod 39 is pivotably connected to the leg 38 and to the door frame 20.

Inside each column 6, a chain 40 in a figure-of-eight configuration extends around the upper and lower gear wheels 11, 12. The chain 40 forms a linking mechanism connecting the ceiling unit 23 to the base unit 37. Each chain 40 is arranged to be driven by a drive motor 41 which rotates a drive shaft 42 on which are mounted a pair of coaxial drive gears 43 which engage the chain 40.

Inside the first end of each ceiling link arm 14 is a gear wheel 44 mounted around and fixed to the upper shaft 7. Inside the second end of each ceiling link arm 14 is a gear wheel 45 mounted around and fixed to the upper link shaft 17, and a chain 46 extends around the upper shaft gear wheel 44 and the upper link shaft gear wheel 45. A ceiling linkage 47 comprises the upper shaft gear wheel 44, the upper link shaft gear wheel 45 and the chain 46 extending around them.

Inside the first end of each base link arm 26 is a gear wheel 48 mounted around and fixed to the lower shaft 8. Inside the second end of each base link arm 26 is a gear wheel 49 mounted around and fixed to the base link shaft 29, and a chain 50 extends around the lower shaft gear wheel 48 and the lower link shaft gear wheel 49. A base linkage 72 comprises the lower shaft gear wheel 48, the lower link shaft gear wheel 49 and the chain 50 extending around them.

A pair of vertical shafts 51, 52 (see FIG. 3) is rotatably mounted in the mounting frame 4 of the collapsible shower cubicle 1. A first end portion of a first side panel 53 is fixed to a first one 51 of the two vertical shafts and a first end portion of a second side panel 54 is fixed to a second one 52 of the two vertical shafts. A distal end of each side panel 53, 54 extends away from its respective shaft 51, 52. The second shaft 52 is located slightly further away from a rear of the mounting frame 4 than the first shaft 51 and has a notch or groove 55 (see FIG. 6) running vertically along it. The side panels 53, 54 may be rotated by motors 71 (see FIG. 19) between retracted and extended positions.

A drain 56 (see FIG. 12) is located in the bottom of the mounting frame 4 for draining water from the shower cubicle 1. The drain 56 has a float sensor 57 to prevent flooding if water is not draining properly from the shower cubicle 1.

A door 58 (see FIGS. 3 to 5) is connected to the door frame 20 by a vertical door shaft or hinge 59 and the door 58 also has an external door handle 60. The door frame 20 has magnets 61 which interact with magnets 62 on the door handle 60 and on the vertical door shaft 59 to dampen movement of the door 58 relative to the door frame 20. The magnets can act as a door stop. The door frame 20 also has an annular seal 74 around the frame 20 for engaging the seal frame 5.

Above the mounting frame 4 are a pair of housings 65 (see FIG. 20) each containing an inline extractor fan 66 and having a flexible pipe 67 extending from the housing 65. Also above the mounting frame 4 is a pump 68 (see FIG. 19) for the shower head, tanks 69, solenoids 70 and other electrical equipment 73 for the shower cubicle 1 wherein the solenoids 70 and other electrical equipment 73 is contained within a waterproof area. The collapsible shower cubicle 1 may have a touch screen control panel to operate it. The control panel may be connected to an electronic processor which is connected to the motors 41, 71, sensor 57, motors for fans 66, and other sensors.

Referring to particularly to FIGS. 2 and 23 to 27, when the shower cubicle 1 is in an erected state (see FIG. 23), the ceiling unit 23 extends horizontally from the upper axis 9 in a raised extended position beyond the seal frame 5, and the base unit 37 extends horizontally from the lower axis 10 in a lowered extended position beyond the seal frame 5. The side panels 53, 54 are in their extended positions and are inside the downwardly extending edges 22 of the ceiling panel 21 and the shoulders 35 of the floor panel 34, and each side panel 53, 55 is adjacent a respective downwardly extending edge 22, and adjacent a respective shoulder 35. A person can enter the erected shower cubicle 1 via the door 58.

Figure 25:
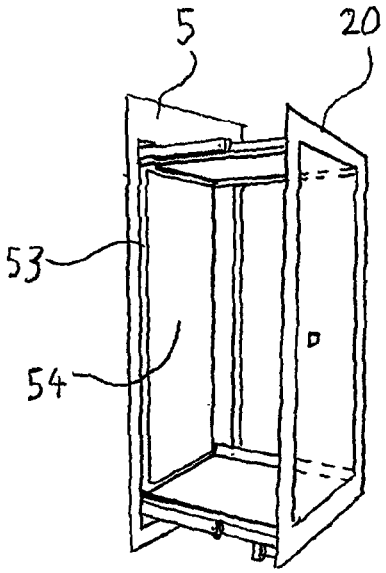
Figure 26:
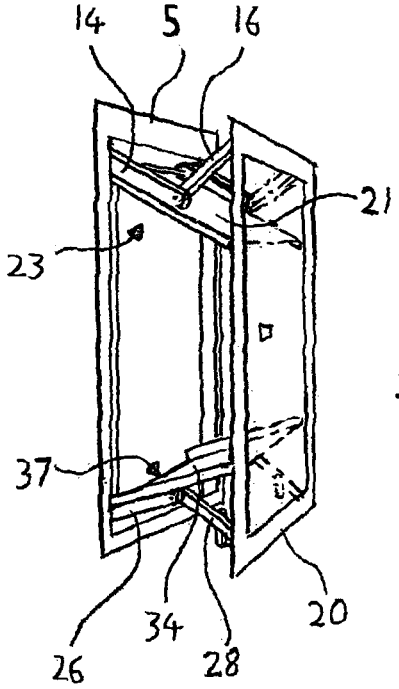
Figure 27:
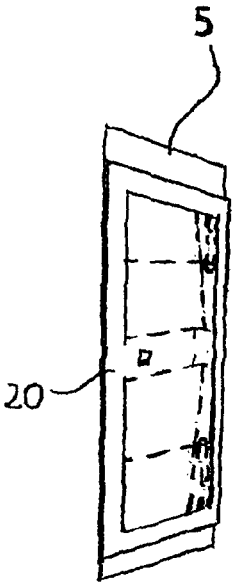

To collapse the shower cubicle 1, the first side panel 53 is rotated through 90° from its extended position to a retracted position wherein the side panel 53 is in the mounting frame 4 within the wall recess 2, and the second side panel 54 is then rotated (see FIG. 24) through 90° from its extended position to a retracted position so that it overlaps the first side panel 53 (see FIG. 25). The drive motors 41 are then activated to drive the chains 40 of the linking mechanisms and rotate the upper and lower gear wheels 11, 12. This coordinates simultaneous rotation (see FIG. 26) of the ceiling unit 23 and the base unit 37 from their respective raised and lowered extended positions to respective lowered and raised retracted positions wherein the raising of the weight of the base unit 37 is counterbalanced by the lowering of the weight of the ceiling unit 23. As the base unit 37 is being raised, any water on the floor panel 34 drains into the drain 56. Also, as the ceiling unit 23 is being lowered and the base unit 37 is being raised, each ceiling link arm chain 46 around its respective upper shaft gear wheel 44 causes the upper link shaft gear wheel 45 to rotate the upper link arm 16 and each base link arm chain 50 around its respective lower shaft gear wheel 48 causes the lower link shaft gear wheel 49 to rotate the lower link arm 28. Thus, the door frame 20 is translated towards the upper and lower axes 9, 10 until it engages the mounting frame 5 with its seal 74 forming a seal with the mounting frame 5. The translation of the door frame 20 causes the drip tray spring valve 33 to engage the mounting frame 4 and consequently be opened so that any water in the drip tray 32 can be released from the tray 32 and drained from the shower cubicle 1 via the drain 56. When the ceiling unit 23 and the base unit 37 are in their respective lowered and raised retracted positions (see FIG. 27) they cover the side panels 53, 54 in their retracted positions. The second side panel 54 in its retracted position has the notch 55 in its vertical shaft 52 positioned to receive portions of the ceiling and base units 23, 37 in their retracted positions. The shower cubicle 1 in its collapsed state has a smart, slim appearance.

To erect the shower cubicle 1, the drive motors 41 are activated to drive the chains 40 of the linking mechanisms in the opposite direction so that the ceiling unit 23 and the base unit 37 are simultaneously rotated from their respective lowered and raised retracted positions to their respective raised and lowered extended positions wherein the lowering of the weight of the base unit 37 is counterbalanced by the raising of the weight of the ceiling unit 23. As the ceiling unit 23 is being raised and the base unit 37 is being lowered, each ceiling link arm chain. 46 around its respective upper shaft gear wheel 44 causes the upper link shaft gear wheel 45 to rotate the upper link arm 16 and each base link arm chain 50 around its respective lower shaft gear wheel 48 causes the lower link shaft gear wheel 49 to rotate the lower link arm 28 so that the door frame 20 is translated away from the upper and lower axes 9, 10. As the base unit 37 is being lowered, the leg 38 on each lower link member 28 is retained in an upright stance by virtue of the rod 39 pivotably connected to it and to the door frame 20, and the legs 38 provide support for the shower cubicle 1 in its erected state. When the ceiling unit 23 is raised to its extended position and the base unit 37 is lowered to its extended position, a distal end of the ceiling panel 21 forms a seal 75 (see FIG. 10) with the door frame 20 and a distal end of the floor panel 34 forms a seal 76 (see FIG. 13) with the door frame 20. Also, a seal is formed between the seals 24 of the ceiling link arms 14 and the sealing frame 5 (see FIGS. 6 and 9) and between the seals 38 of the base link arms 26 and the sealing frame 5 (see FIG. 12).

The second and the first side panels 54, 53 are rotated through 90° from their retracted positions to their extended positions. When the side panels 53, 54 are in their extended positions, a seal is formed between the side panels 53, 54 and the downwardly extending edges 22 of the ceiling panel 21 and a seal 77 (see FIG. 18) is also formed between the side panels 53, 54 and the shoulders 35 of the floor panel 34. The distal ends of the side panels 53, 54 form a seal 78 (see FIG. 16) with the door frame 20.

The seals between the ceiling unit 23 and the base unit 37 and the seal frame 5 and door frame 20, and the seals between the side panels 53, 54 and the ceiling unit 23 and the base unit 24 and the door frame 20 are waterproof and may be magnetic.

The shower cubicle 1 may be a folding or collapsible shower cubicle that may be fully automated. The shower cubicle 1 may be integrated into a wall.

In a specific example of a preferred embodiment, the drive motor 41 is a low voltage and wattage DC motor. Due to the counterbalancing mentioned previously, such a low powered motor 41 can be used to extend or retract the ceiling and base units 23, 37 of the shower cubicle 1 when the shower cubicle 1 is being erected or collapsed. The shower cubicle 1 can be fitted to a recess 2 only 175 mm deep in a wall 3. The side panels 53, 54 may comprise toughened glass which may be 6 mm thick. The door 58 may comprise toughened glass.

Whilst a particular embodiment has been described, it will be understood that various modifications may be made without departing from the scope of the claimed invention.

The linking mechanism comprising a chain 40 in a figure-of-eight configuration extending around the upper and lower gear wheels 11, 12 may be instead replaced by a system of gears and/or rods wherein at least one of the gears may be coaxial with at least one of the rods.

The shower cubicle 1 may include a sprinkler to clean the side panels 53, 54 when they are in their retracted positions. The door 58 may comprise a see through mirror that can be seen through from inside the shower cubicle 1. The shower cubicle 1 may include speakers for playing music inside the cubicle 1.

The invention claimed is:

1. A collapsible shower cubicle comprising:

a ceiling unit rotatable about an upper axis between a raised extended position and a lowered retracted position, the ceiling unit substantially extending horizontally from the upper axis when the ceiling unit is in its extended position;

a base unit rotatable about a lower axis between a lowered extended position and a raised retracted position, the base unit substantially extending horizontally from the lower axis when the base unit is in its extended position;

a linking mechanism connecting the ceiling unit to the base unit and configured to coordinate simultaneous rotation of the ceiling unit and the base unit between their retracted and extended positions and configured such that the raising of the weight of the base unit is counterbalanced by the lowering of the weight of the ceiling unit, and the lowering of the weight of the base unit is counterbalanced by the raising of the weight of the ceiling unit; and a door frame and a door comprising a substantially rigid panel connected to the door frame for entry into the collapsible shower cubicle.

2. The collapsible shower cubicle as claimed in claim 1, wherein the ceiling unit includes a ceiling panel rotatable about the upper axis.

3. The collapsible shower cubicle as claimed in claim 2, wherein the base unit includes a base panel rotatable about the lower axis.

4. The collapsible shower cubicle as claimed in claim 3, including an upper link member pivotably attached directly or indirectly to the ceiling panel of the ceiling unit, a lower link member pivotably attached directly or indirectly to the base panel of the base unit, the door frame pivotably attached to the upper and lower link members.

5. The collapsible shower cubicle as claimed in claim 4, wherein when the ceiling unit is rotated from the raised extended position to the lowered retracted position and the base unit is rotated from the lowered extended position to the raised retracted position, the door frame is translated towards the upper and lower axes, and when the ceiling unit is rotated from the lowered retracted position to the raised extended position and the base unit is rotated from the raised retracted position to the lowered extended position, the door frame is translated away from the upper and lower axes.

6. The collapsible shower cubicle as claimed in claim 4, including a ceiling linkage configured to rotate the upper link member relative to the ceiling panel.

7. The collapsible shower cubicle as claimed in claim 6, wherein the ceiling linkage connects the upper link member to a ceiling shaft coaxial with the upper axis.

8. The collapsible shower cubicle as claimed in claim 4, including a base linkage configured to rotate the lower link member relative to the base panel.

9. The collapsible shower cubicle as claimed in claim 8, wherein the base linkage connects the lower link member to a base shaft coaxial with the lower axis.

10. The collapsible shower cubicle as claimed in claim 4, wherein the door and the door frame each have at least one magnet for interacting with each other to dampen movement of the door relative to the door frame.

11. The collapsible shower cubicle as claimed in claim 1, wherein the linking mechanism connects the ceiling unit to the base unit about the upper and lower axes.

12. The collapsible shower cubicle as claimed in claim 11, wherein the linking mechanism comprises a belt or chain in a figure-of-eight configuration connecting the ceiling unit to the base unit and extending around the upper and lower axes.

13. The collapsible shower cubicle as claimed in claim 12, wherein the belt or chain extends around an upper wheel rotatable about the upper axis and extends around a lower wheel rotatable about the lower axis, the ceiling unit being fixed to the upper wheel and the base unit being fixed to the lower wheel.

14. The collapsible shower cubicle as claimed in claim 1, including a drive mechanism for driving the linking mechanism to selectively rotate the ceiling unit and the base unit towards each other from their extended positions or to rotate the ceiling unit and the base unit away from each other from their retracted positions.

15. A collapsible shower cubicle comprising:

a pair of substantially rigid side panels movable between extended positions and retracted positions;

a ceiling unit movable between a raised extended position and a lowered retracted position;

a base unit movable between a lowered extended position and a raised retracted position;

an upper link member pivotably attached to the ceiling unit;

a lower link member pivotably attached to the base unit, and a door frame pivotably attached to the upper and lower link members, and a door comprising a substantially rigid panel connected to the door frame for entry into the collapsible shower cubicle, wherein the shower cubicle is in an erected state when the side panels, the ceiling unit and the base unit are in their extended positions, and the shower cubicle is in a collapsed state when the side panels, the ceiling unit and the base unit are in their retracted positions, and wherein when the collapsible shower cubicle is moved from its erected state to its collapsed state, the side panels are moved towards their retracted positions before the base unit is moved to its retracted position.

16. The collapsible shower cubicle as claimed in claim 15, wherein the base unit includes a floor panel that is rotated from a lowered extended position to a raised retracted position.

17. The collapsible shower cubicle as claimed in claim 16, wherein the floor panel in its raised retracted position covers at least a portion of the side panels in their retracted positions.

18. The collapsible shower cubicle as claimed in claim 16, wherein the floor panel has a pair of shoulders and wherein each side panel is adjacent a respective said shoulder when the side panels and the base unit are in their extended positions, the side panels being between the shoulders.

19. The collapsible shower cubicle as claimed in claim 16, including a drain for collecting water from the floor panel as it is being rotated from its extended position to its retracted position.

20. The collapsible shower cubicle as claimed in claim 15, wherein the door and the door frame each have at least one magnet for interacting with each other to dampen movement of the door relative to the door frame.

21. The collapsible shower cubicle as claimed in claim 15, whereby translation of the door frame in a horizontal direction synchronizes movement of the base unit and the ceiling unit between their respective retracted and extended position.

22. A collapsible shower cubicle comprising:

a ceiling unit rotatable about an upper axis between a raised extended position and a lowered retracted position, the ceiling unit substantially extending horizontally from the upper axis when the ceiling unit is in its extended position, wherein the ceiling unit includes a ceiling panel rotatable about the upper axis;

a base unit rotatable about a lower axis between a lowered extended position and a raised retracted position, the base unit substantially extending horizontally from the lower axis when the base unit is in its extended position, wherein the base unit includes a base panel rotatable about the lower axis;

a linking mechanism connecting the ceiling unit to the base unit and configured to coordinate simultaneous rotation of the ceiling unit and the base unit between their retracted and extended positions and configured such that the raising of the weight of the base unit is counterbalanced by the lowering of the weight of the ceiling unit, and the lowering of the weight of the base unit is counterbalanced by the raising of the weight of the ceiling unit; and an upper link member pivotably attached directly or indirectly to the ceiling panel of the ceiling unit, a lower link member pivotably attached directly or indirectly to the base panel of the base unit, a door frame pivotably attached to the upper and lower link members, and a door comprising a substantially rigid panel to the door frame for entry into the collapsible shower cubicle.

* * * * *